US008770175B2

(12) United States Patent
Kitamura et al.

(10) Patent No.: US 8,770,175 B2
(45) Date of Patent: Jul. 8, 2014

(54) EVAPORATION FUEL PROCESSING SYSTEM AND PURGING METHOD THEREFOR

(75) Inventors: Hiroshi Kitamura, Mooka (JP); Masakazu Kitamoto, Shimotsuke (JP); Masaru Oku, Sakura (JP); Yoshikazu Kaneyasu, Utsunomiya (JP); Mitsunobu Yamamoto, Ohtawara (JP); Kentaro Ito, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 1262 days.

(21) Appl. No.: 12/623,653

(22) Filed: Nov. 23, 2009

(65) Prior Publication Data

US 2010/0132676 A1 Jun. 3, 2010

(30) Foreign Application Priority Data

Nov. 28, 2008 (JP) ..... 2008-304345
Dec. 16, 2008 (JP) ..... 2008-319610

(51) Int. Cl.
*F02M 25/08* (2006.01)

(52) U.S. Cl.
CPC ..... *F02M 25/089* (2013.01); *F02M 25/0836* (2013.01)
USPC ..... 123/520

(58) Field of Classification Search
CPC ..... F02M 25/0836; F02M 25/089
USPC ..... 123/519, 520
See application file for complete search history.

(56) References Cited

U.S. PATENT DOCUMENTS

| | | | | |
|---|---|---|---|---|
| 5,371,412 | A | 12/1994 | Iwashita et al. | |
| 5,962,927 | A * | 10/1999 | Inada et al. | 290/40 R |
| 6,012,435 | A | 1/2000 | Takahashi et al. | |
| 6,057,262 | A * | 5/2000 | Derbyshire et al. | 502/423 |
| 6,279,548 | B1 * | 8/2001 | Reddy | 123/520 |
| 6,557,534 | B2 * | 5/2003 | Robichaux et al. | 123/520 |
| 6,689,196 | B2 * | 2/2004 | Amano et al. | 96/112 |
| 6,817,346 | B2 * | 11/2004 | Konishi et al. | 123/519 |
| 7,484,500 | B2 | 2/2009 | Terada | |
| 7,775,195 | B2 * | 8/2010 | Schondorf et al. | 123/520 |
| 8,104,454 | B2 * | 1/2012 | Schondorf et al. | 123/520 |
| 8,245,699 | B2 * | 8/2012 | Peters et al. | 123/518 |

(Continued)

FOREIGN PATENT DOCUMENTS

| | | | |
|---|---|---|---|
| JP | 06-159155 | A | 6/1994 |
| JP | 6-233410 | A | 8/1994 |

(Continued)

*Primary Examiner* — Hieu T Vo
*Assistant Examiner* — Arnold Castro
(74) *Attorney, Agent, or Firm* — Carrier Blackman & Associates, P.C.; Joseph P. Carrier; Jeffrey T. Gedeon

(57) ABSTRACT

An evaporation fuel processing system is equipped with a vapor passage, a canister, a purging passage, a purge control valve, a filling amount detector, and an ECU. The ECU comprises an adsorption amount detecting circuit that detects the adsorption amount of an evaporation fuel, which is adsorbed by the canister upon filling of the fuel at a time when a fuel is filled into a fuel tank, a breakthrough time calculating circuit that calculates a time, based on the detected adsorption amount, at which the canister would experience breakthrough in the event that the evaporation fuel were not purged into an engine from the canister, and a control circuit that carries out purge processing by the purge control valve based on the calculated time.

24 Claims, 26 Drawing Sheets

(56) References Cited

U.S. PATENT DOCUMENTS

| | | | | |
|---|---|---|---|---|
| 8,443,787 | B2 * | 5/2013 | Schondorf et al. | 123/520 |
| 2003/0140901 | A1 * | 7/2003 | Amano et al. | 123/520 |
| 2004/0129257 | A1 * | 7/2004 | Konishi et al. | 123/520 |
| 2005/0011499 | A1 * | 1/2005 | Hara et al. | 123/520 |
| 2007/0119411 | A1 * | 5/2007 | Kerns | 123/295 |
| 2008/0236551 | A1 * | 10/2008 | Althof et al. | 123/520 |
| 2008/0271718 | A1 * | 11/2008 | Schondorf et al. | 123/520 |
| 2010/0307463 | A1 * | 12/2010 | Peters et al. | 123/520 |

FOREIGN PATENT DOCUMENTS

| | | | |
|---|---|---|---|
| JP | 10-047172 | A | 2/1998 |
| JP | 10-196467 | A | 7/1998 |
| JP | 11-044237 | A | 2/1999 |
| JP | 2000-045886 | A | 2/2000 |
| JP | 2002-081350 | A | 3/2002 |
| JP | 2004-156492 | A | 6/2004 |
| JP | 2005-147057 | A | 6/2005 |
| JP | 2007-270690 | A | 10/2007 |

* cited by examiner

EVAPORATION FUEL PROCESSING SYSTEM AND PURGING METHOD THEREFOR

CROSS-REFERENCE TO RELATED APPLICATION

This application is based upon and claims the benefit of priority from Japanese Patent Applications No. 2008-304345 filed on Nov. 28, 2008 and No. 2008-319610 filed on Dec. 16, 2008, of which the contents are incorporated herein by reference.

BACKGROUND OF THE INVENTION

1. Field of the Invention

The present invention relates to an evaporation fuel processing system and a purging method therefor, which is equipped with a first communication passage through which an evaporation fuel generated inside of a fuel tank that stores fuel is introduced, a canister connected to the first passage and which adsorbs the evaporation fuel, a second communication passage that communicates between the canister and an intake passage of an internal combustion engine, and a purging processor for purging the evaporation fuel adsorbed by the canister into the internal combustion engine through the second communication passage.

2. Description of the Related Art

In order to supply fuel to an internal combustion engine, a fuel tank is used. Inside the fuel tank, an evaporation fuel (vapor), which is gassed out from the fuel, is generated. In order to prevent dispersion of the evaporation fuel into the atmosphere unnecessarily, a canister is provided.

The canister is filled with an adsorptive material such as activated carbon or the like, which adsorbs and collects the evaporation fuel. The collected evaporation fuel is purged into the intake passage of the internal combustion engine through a purging passage during running of the internal combustion engine. Owing thereto, breakthrough (outflowing) of the evaporation fuel from the canister drain is decreased.

Incidentally, there are times when after fuel has been filled into the fuel tank, running of the internal combustion engine may be stopped for long periods of time. In particular, with a hybrid system in which the internal combustion engine and an electric motor are used in common, there may be cases in which driving is performed only under operation of the motor, and where operation of the internal combustion engine is not conducted for a prolonged period.

At such times, inside the fuel tank, a large amount of evaporation fuel is easily generated, whereas the frequency of purging of evaporation fuel from the canister becomes quite small. As a result, cases occur in which the evaporation fuel, which cannot be collected by the canister, is simply released into the atmosphere.

Consequently, for example, as disclosed in Japanese Laid-Open Patent Publication No. 06-233410 (hereinafter referred to as Reference No. 1), a control apparatus for a generator-driving engine is known. In Reference No. 1, an electric vehicle is disclosed, having an engine that receives supply of fuel from a fuel tank and a generator, which is driven by mechanical output from the engine for generating electricity. In the control apparatus for controlling at least operations of the engine, there are disclosed, respectively, means for detecting the fuel vapor amount inside the fuel tank under a condition in which the engine is stopped, means for initiating driving of the engine in the case that the detected vapor amount exceeds a first predetermined amount, means for detecting the fuel vapor amount inside the fuel tank under a condition in which the engine is driven, and means for stopping the engine in the event that the detected vapor amount falls to or below a second predetermined value, the apparatus being characterized by the feature in that the second predetermined amount is smaller than the first predetermined amount.

However, when an internal combustion engine is not driven over a prolonged period of time, along with the passage of time, leakage of the evaporation fuel that has been adsorbed by the canister to the exterior occurs easily. Notwithstanding this fact, in the aforementioned Reference No. 1, purge processing is performed only upon detection of a fuel vapor amount inside the fuel tank. There is no disclosure of methods or practices for reducing breakthrough of evaporation fuel from a canister.

SUMMARY OF THE INVENTION

The present invention solves the above-noted problems, and has the object of providing an evaporation fuel processing system and purging method therefor, which is capable of reliably preventing breakthrough of an evaporation fuel from a canister.

The present invention relates to an evaporation fuel processing system, which is equipped with a first communication passage through which an evaporation fuel generated inside of a fuel tank that stores fuel is introduced, a canister connected to the first communication passage and which adsorbs the evaporation fuel, a second communication passage that communicates between the canister and an intake passage of an internal combustion engine, and a purging processor for purging the evaporation fuel adsorbed by the canister into the internal combustion engine through the second communication passage.

The evaporation fuel processing system further comprises a canister adsorption capacity detecting device for detecting whether or not an adsorption amount of the evaporation fuel adsorbed by the canister is of an amount that would cause breakthrough of the canister, and a controller for carrying out purge processing by the purging processor based on a detection result of the canister adsorption capacity detecting device. In this case, the breakthrough of the canister includes a case in which it is judged that the canister would experience breakthrough.

Further, the present invention relates to a purging method for an evaporation fuel processing system, in which the evaporation fuel processing system comprises a first communication passage through which an evaporation fuel generated inside of a fuel tank that stores fuel is introduced, a canister connected to the first communication passage and which adsorbs the evaporation fuel, a second communication passage that communicates between the canister and an intake passage of an internal combustion engine, and a purging processor for purging the evaporation fuel adsorbed by the canister into the internal combustion engine through the second communication passage.

In this case, the purging method comprises the steps of detecting whether or not an adsorption amount of the evaporation fuel adsorbed by the canister is of an amount that would cause breakthrough of the canister, and carrying out purge processing by the purging processor when it is detected that the adsorption amount of the evaporation fuel is of an amount that would cause breakthrough of the canister.

According to the present invention, before the canister by which the evaporation fuel is adsorbed experiences breakthrough, purge processing can be carried out. Consequently, and in particular in a hybrid system, even when the internal combustion engine is stopped or not driven over a prolonged time period, breakthrough from the canister can reliably be prevented.

In addition, the adsorption state of the canister can be detected with high precision. Owing thereto, the time during which the internal combustion engine is operated can be suppressed to only a minimum necessary level, so that fuel consumption is decreased, thus making the system and method highly economical.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
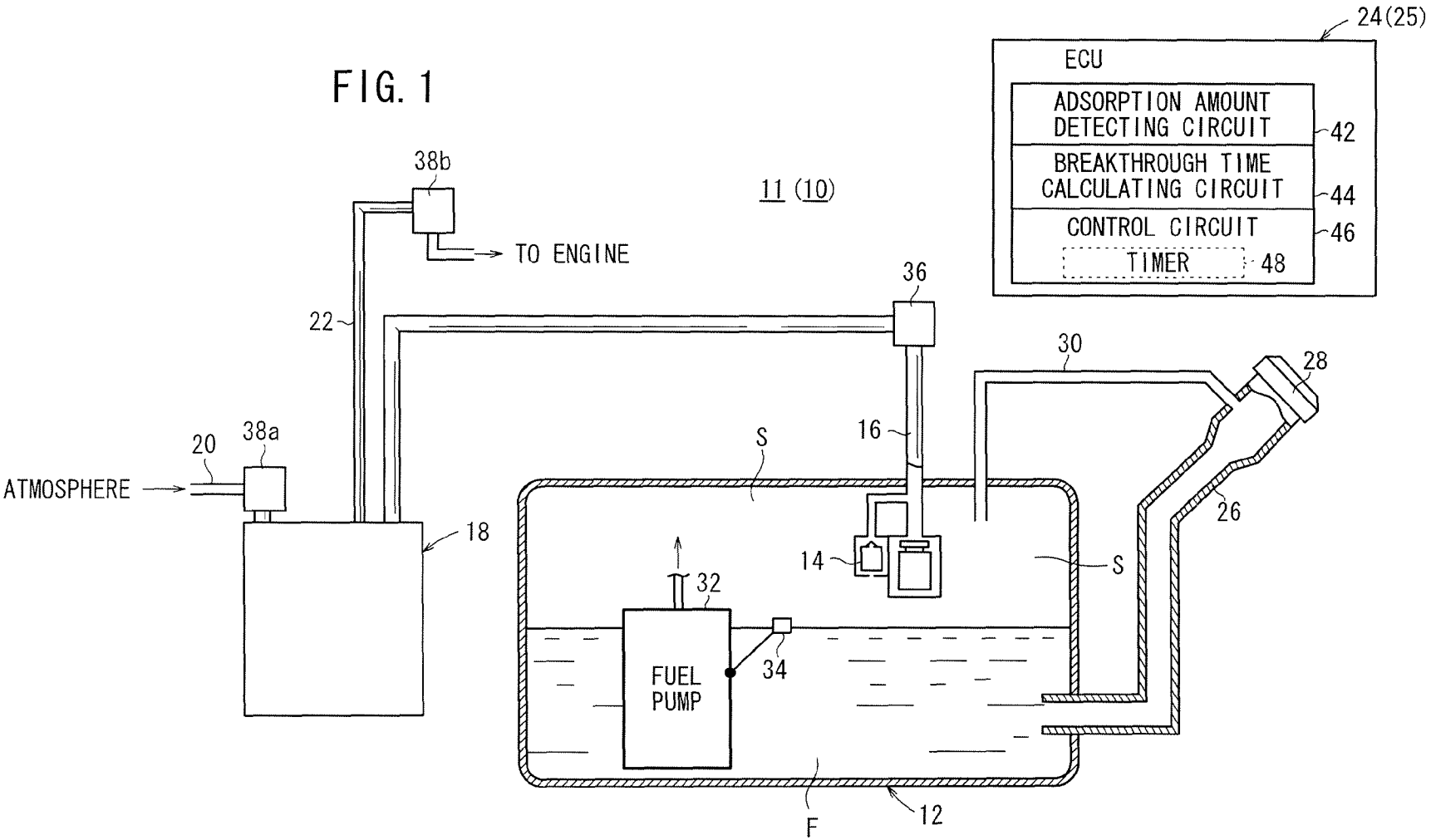
FIG. 1 is an outline schematic view of fuel tank equipment, to which the evaporation fuel processing system according to a first embodiment of the present invention is applied.

FIG. 1 is an outline schematic view of fuel tank equipment 11, to which an evaporation fuel processing system 10 according to a first embodiment of the present invention is applied. In particular, the fuel tank equipment 11 preferably is applied to a hybrid system in which an engine (not shown) and a motor (not show) are used in tandem.

The fuel tank equipment 11 comprises a fuel tank 12 that stores a fuel F therein, a vapor passage (first communication passage) 16 through which an evaporation fuel (vapor) from inside the fuel tank 12 is introduced from a float 14, a canister 18 connected to the vapor passage 16 and which adsorbs the evaporation fuel, a drain passage 20 for communicating between the canister 18 and external air, through the drain passage 20 external air being introduced into the canister 18 when the evaporation fuel is purged, a purging passage (second communication passage) 22 through which the evaporation fuel that has been adsorbed by the canister 18 is suctioned (purged) into an intake passage that communicates with the engine (not shown) at a time when the engine is driven, and an ECU (electronic control unit) 24.

The evaporation fuel processing system 10 is equipped with a canister adsorption capacity detecting device 25 for detecting whether or not an adsorption amount of the evaporation fuel adsorbed by the canister 18 is of an amount that would cause breakthrough of the canister 18, and a controller (to be described later) for carrying out purge processing by a purging processor (also described later) based on a detection result of the canister adsorption capacity detecting device 25.

One end of a filling pipe member 26 is attached to the fuel tank 12. A cap 28 is installed onto the other end of the filling pipe member 26, and together therewith, a breather pipe 30 is disposed to approach toward a space S of the fuel tank 12 from a position in the vicinity of the cap 28.

Inside the fuel tank 12, there are arranged a fuel pump 32 for supplying the fuel F stored in the fuel tank 12 to the engine, and a filling amount detector (e.g., a float) 34, which detects the filled amount of the fuel F that has been filled into the fuel tank 12.

The interior of the canister 18 is filled with an adsorptive material (not shown) such as activated carbon or the like. A sealing valve 36 is disposed in the vapor passage 16. A drain control valve (hereinafter also referred to as a sealing valve)

38*a* and a purge control valve 38*b* are disposed, respectively, in the drain passage 20 and the purging passage 22. The purge control valve 38*b* constitutes a purging processor, which purges the evaporation fuel adsorbed by the canister 18 into the internal combustion engine.

The ECU 24 comprises an adsorption amount detecting circuit (adsorption amount detecting mechanism) 42, which detects an amount of the evaporation fuel adsorbed by the canister 18 by means of filling of the fuel, at a time when the fuel F is filled into the fuel tank 12, a breakthrough time calculating circuit (breakthrough time calculating mechanism) 44 for calculating a time, based on the detected adsorption amount, at which the canister 18 would experience breakthrough in the event that the evaporation fuel were not purged into the internal combustion engine from the canister 18, and a control circuit (controller) 46 for starting the engine and carrying out purge processing by opening the purge control valve 38*b* based on the calculated time. A timer 48 which serves as a timing means is connected to the control circuit 46.

The adsorption amount detecting circuit 42 is equipped with the filling amount detector 34 such that, based on the detected filled amount, as detected via the filling amount detector 34, the adsorption amount of the evaporation fuel adsorbed by the canister 18 is detected.

Figure 2:
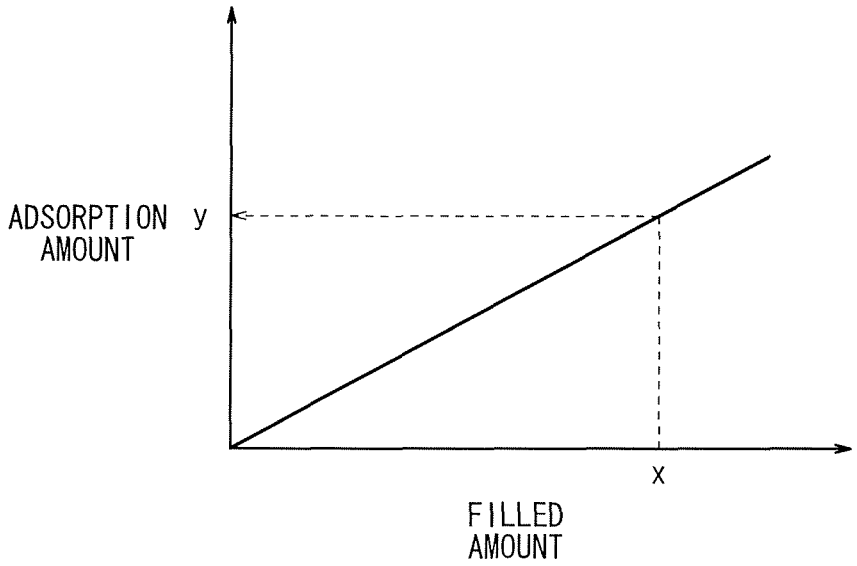
FIG. 2 is a graph showing the relationship between a filled amount and an adsorption amount of the fuel.

The control circuit 46, for example as shown in FIG. 2, includes the relationship between the filled amount and the adsorption amount preset therein as a map or as a computational expression. In this case, as shown in FIG. 2, the filled amount is represented by x and the adsorption amount is represented by y. However, in the case that the fuel tank 12 is a sealed tank, since during filling depressurization is carried out inside the fuel tank 12, in actuality, a vapor amount portion due to depressurization flows out into the canister 18 and is adsorbed therein. Accordingly, for a sealed tank or the like, in the case that depressurizing is required, it is preferable for the adsorption amount due to the vapor amount that flows out into the canister 18 to be added to the adsorption amount y calculated from the relationship of FIG. 2, such that a substantive adsorption amount is calculated.

Figure 3:
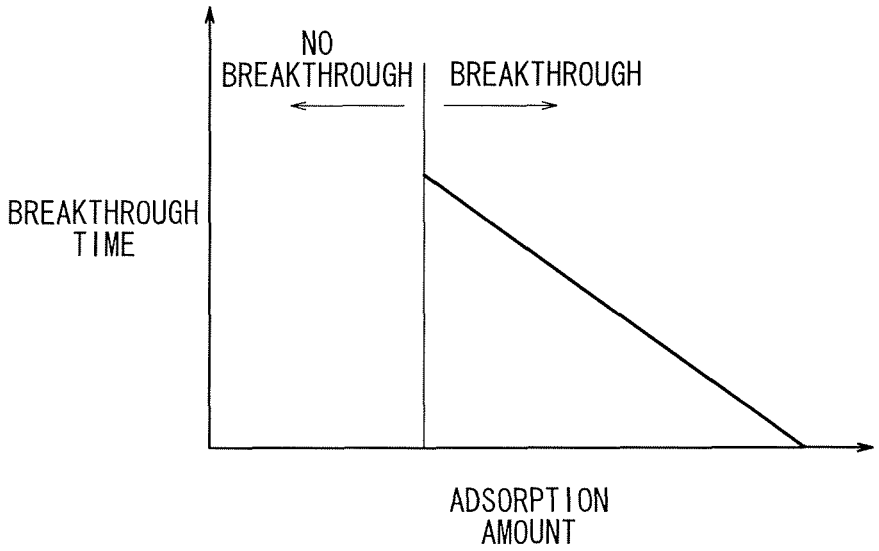
FIG. 3 is a graph showing the relationship between an adsorption amount of the fuel and a time at which breakthrough occurs.

Further, for example as shown in FIG. 3, the control circuit 46 includes the relationship between the adsorption amount and a time at which the canister 18 experiences breakthrough, preset therein as a map or as a computational expression.

The vapor passage 16, the canister 18, the purging passage 22, the purge control valve 38*b*, the filling amount detector 34 and the ECU 24 collectively constitute the evaporation fuel processing system 10 according to the first embodiment. The canister adsorption capacity detecting device 25 comprises the adsorption amount detection circuit 42 and the breakthrough time calculating circuit 44.

Figure 4:
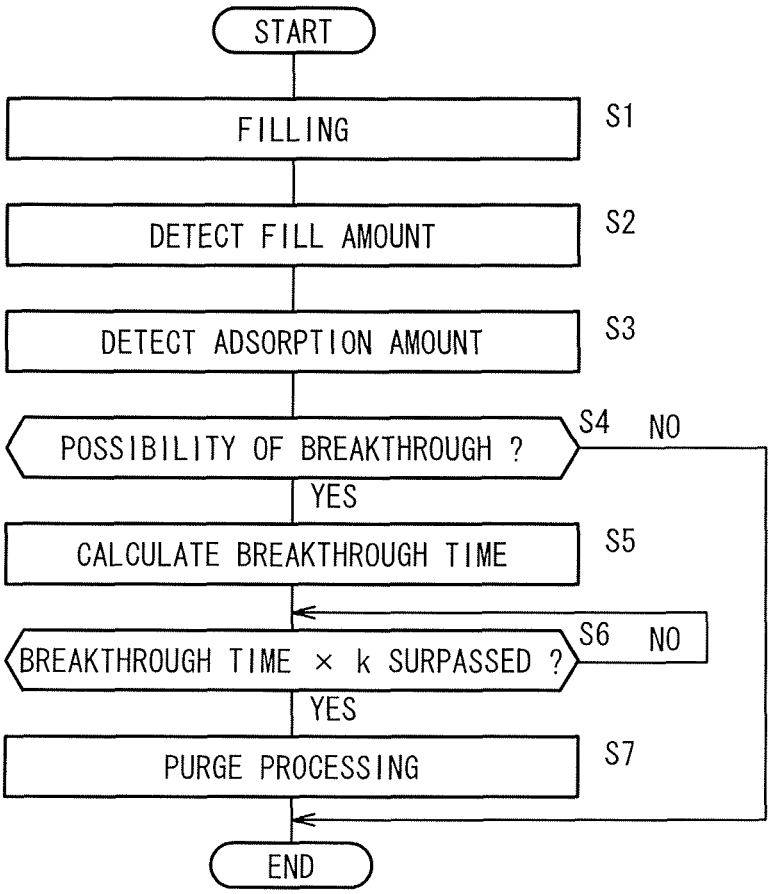
FIG. 4 is a flowchart that describes a purging method in relation to the first embodiment of the present invention.

Operations of the fuel tank equipment 11 shall be described along with the flowchart shown in FIG. 4, in relation to a purging method in accordance with the first embodiment of the present invention.

At first, the cap 28, which is installed onto the other end of the filling pipe member 26, is removed, and a fuel F is poured into the filling pipe member 26. Owing thereto, the fuel F is filled into the fuel tank 12 (step S1), and a predetermined amount of the fuel F is stored inside the fuel tank 12.

When filling of fuel into the fuel tank 12 is finished, the filled amount inside the fuel tank 12 is detected via the filling amount detector 34 (step S2). The adsorption amount detecting circuit 42 then detects, from the relationship between the filled amount and the adsorption amount shown in FIG. 2, the adsorption amount of the evaporation fuel adsorbed by the canister 18 based on the filled amount, which was detected via the filling amount detector 34 (step S3).

Next, based on the detected adsorption amount, when it is judged that there is a possibility for breakthrough to occur (YES in step S4), the routine proceeds to step S5, whereupon the breakthrough time of the canister 18 is calculated (see FIG. 3). When the calculated breakthrough time×k (k≤1) is timed in the control circuit 46, i.e., when it is determined that the breakthrough time×k has elapsed (YES in step S6), purge processing is carried out in step S7.

During purge processing, the non-illustrated engine is started and fuel F stored in the fuel tank 12 is supplied to the engine via the fuel pump 32. On the other hand, by supplying air to the engine, a negative pressure is generated in the intake passage (not shown), and the evaporation fuel collected in the canister 18 is suctioned into the purging passage 22 under a valve-opening action of the purge control valve 38*b*.

At this time, by opening the drain control valve 38*a*, external air flows into the canister 18 from the drain passage 20. Accordingly, the evaporation fuel that was adsorbed by the canister 18 becomes mixed with the introduced external air, and is purged into the intake passage.

Further, in step S4, if it is judged, based on the detected adsorption amount, that there is no possibility for breakthrough to occur (NO in step S4), purge processing is not performed and the routine of FIG. 4 is brought to an end.

In this case, according to the first embodiment, before the canister 18, which has adsorbed evaporation fuel due to filling of the fuel tank 12, can experience breakthrough along with the passage of time, the engine is started and the evaporation fuel inside the canister 18 can be purged. As a result, especially in a hybrid system, even when the engine is stopped over a prolonged period of time, breakthrough from the canister 18 can reliably be prevented from occurring.

In addition, the adsorption state of the canister 18 can be detected with high precision. Owing thereto, the time during which the internal combustion engine is operated can be suppressed to only a minimum necessary level, so that fuel consumption is decreased, thus making the system and method highly economical.

Figure 5:
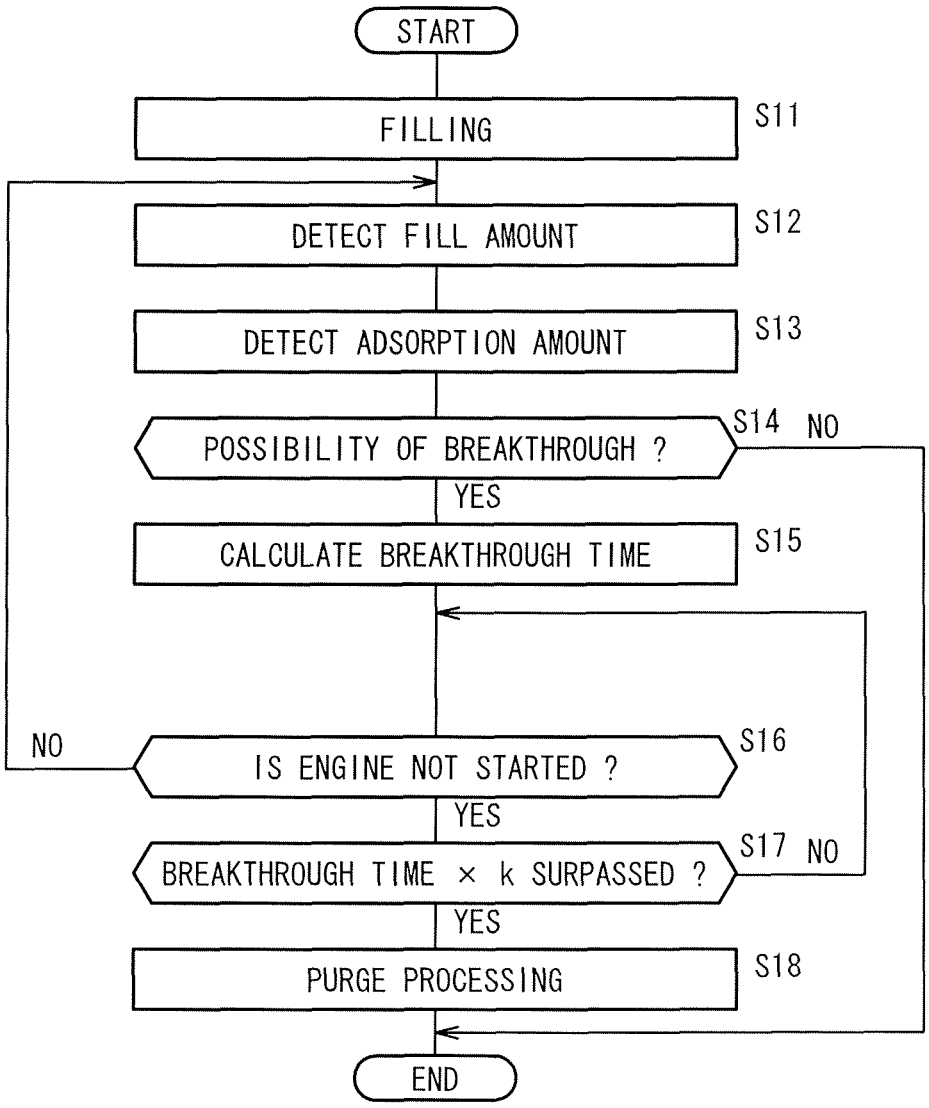
FIG. 5 is a flowchart that describes a purging method in relation to a second embodiment of the present invention.

FIG. 5 is a flowchart that describes a purging method in relation to a second embodiment of the present invention. Detailed explanations of process steps, which are the same as those of the purging method according to the first embodiment shown in FIG. 4, shall be omitted.

In the second embodiment, the steps after the fuel tank 12 has been filled (step S11) and until the step at which the breakthrough time of the canister 18 is calculated (step S15) are carried out the same as step S1 through step S5 according to the first embodiment.

In addition, before the breakthrough time of the canister 18 has elapsed, if the engine is started (NO in step S16), step S12 is returned to and the filled amount inside the fuel tank 12 is detected. Furthermore, based on the remaining filled amount, when it is judged that the canister has a possibility of experiencing breakthrough (YES in step S14), the process from step S15 and subsequent steps thereafter are carried out.

In this manner, according to the second embodiment, before the breakthrough time of the canister 18 has elapsed, when the engine is started, variations in the adsorption amount of the canister 18, which vary in accordance with the running time of the engine, are taken into consideration, whereupon the breakthrough time of the canister 18 can be recalculated. As a result thereof, the state of the canister 18 can be detected with higher precision, and a suitable purging process can be implemented reliably.

Figure 6:
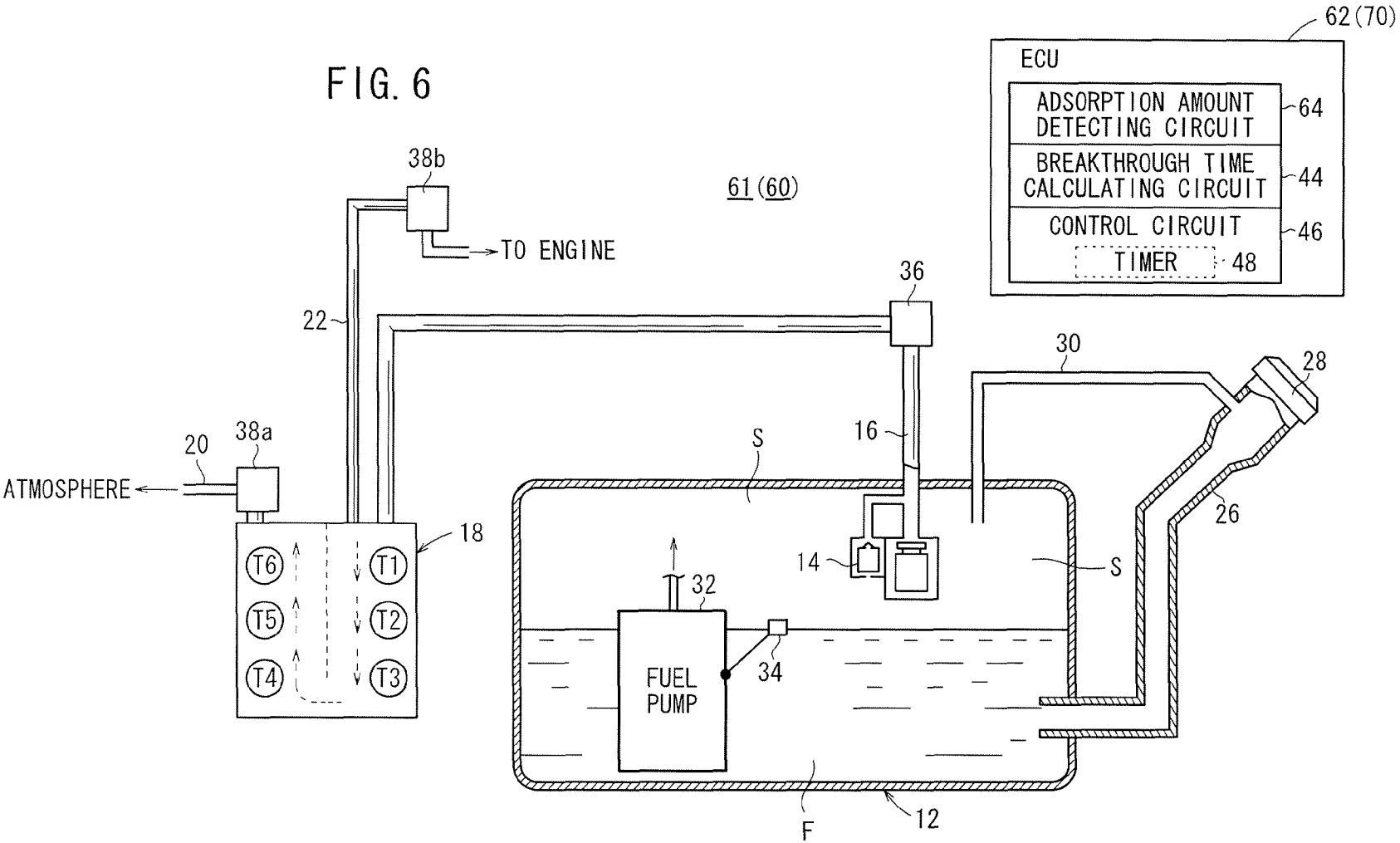
FIG. 6 is an outline schematic view of fuel tank equipment, to which the evaporation fuel processing system according to a third embodiment of the present invention is applied.

FIG. 6 is an outline schematic view of fuel tank equipment 61, to which an evaporation fuel processing system 60 according to a third embodiment of the present invention is applied. The fuel tank equipment 61 is of a structure similar to that of the fuel tank equipment 11, and features thereof, which are the same as those of the fuel tank equipment 11, are designated by the same reference characters, and detailed descriptions of such features shall be omitted. Further, in the descriptions of the fourth embodiment, and other embodiments thereafter to be described below, detail descriptions of common features therein shall be omitted.

The fuel tank equipment 61 is operatively controlled via an ECU (electronic control unit) 62. The ECU 62 comprises an adsorption amount detecting circuit (adsorption amount detecting mechanism) 64, which detects an adsorption amount of the evaporation fuel adsorbed by the canister 18 due to filling when the fuel F is filled into the fuel tank 12, a breakthrough time calculating circuit (breakthrough time calculating mechanism) 44 for calculating a time, based on the detected adsorption amount, at which the canister 18 would experience breakthrough in the event that the evaporation fuel were not purged into the internal combustion engine from the canister 18, and a control circuit (controller) 46 for starting the engine and carrying out purge processing by opening the purge control valve 38*b* based on the calculated time.

The adsorption amount detecting circuit 64 comprises a temperature variation detector made up, for example, from a plurality of temperature sensors T1 through T6, for detecting a temperature change of the canister 18 when the fuel tank 12 is filled. In order that each of the temperature sensors T1 through T6 detects a temperature change for each of respective areas inside the canister 18, the temperature sensors T1 through T6 are arranged in order along the flow direction from an inlet toward an outlet inside the canister 18. The adsorption amount detecting circuit 64 detects the adsorption amount of the canister 18 based on the detected temperature change.

Figure 7:
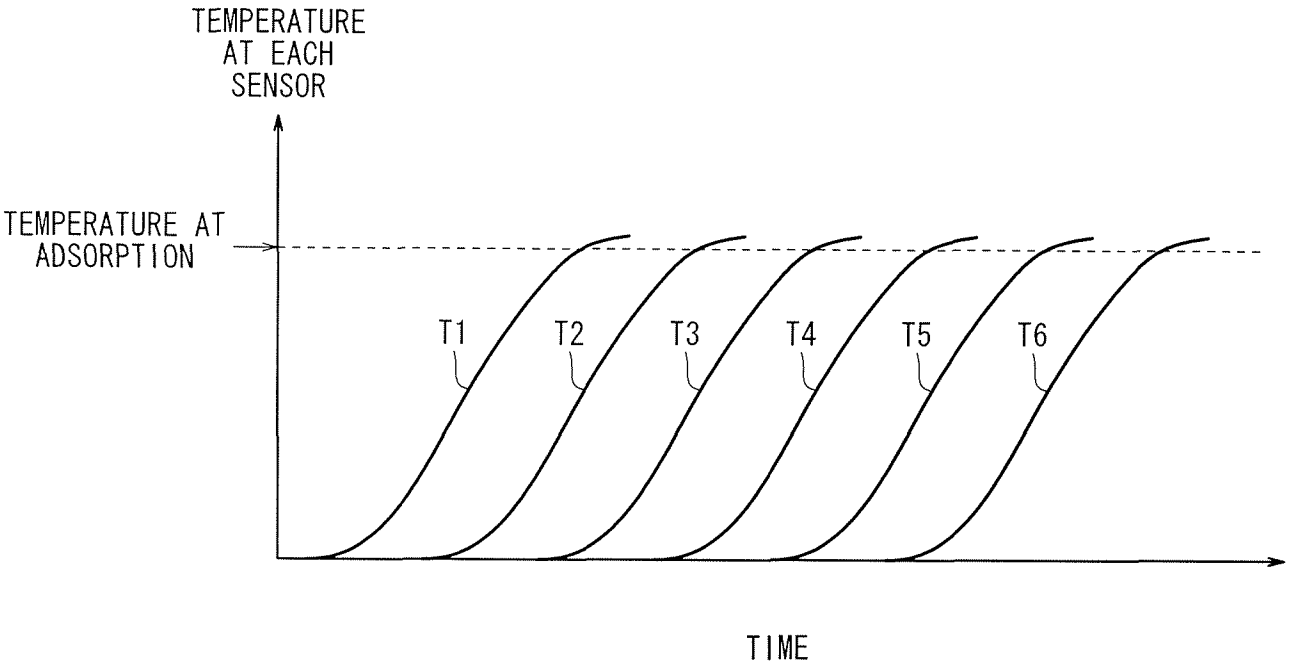
FIG. 7 is a graph showing a relationship between respective attainment temperatures of a temperature sensor occurring upon adsorption and time.

The control circuit 46, for example as shown in FIG. 7, calculates the adsorption amount inside the canister 18 by detecting whether or not an adsorption temperature has been reached by each of the temperature sensors T1 through T6. At such a time, the relationship between the detected temperature of each of temperature sensors T1 through T6 and the adsorption amount is calculated based on FIG. 8.

The vapor passage 16, the canister 18, the purging passage 22, the purge control valve 38*b*, a temperature sensor 66 and the ECU 62 collectively constitute the evaporation fuel processing system 60 according to the third embodiment. The evaporation fuel processing system 60 comprises a canister adsorption capacity detecting device 70, and the canister adsorption capacity detecting device 70 comprises the adsorption amount detection circuit 64 and the breakthrough time calculating circuit 44.

Figure 9:
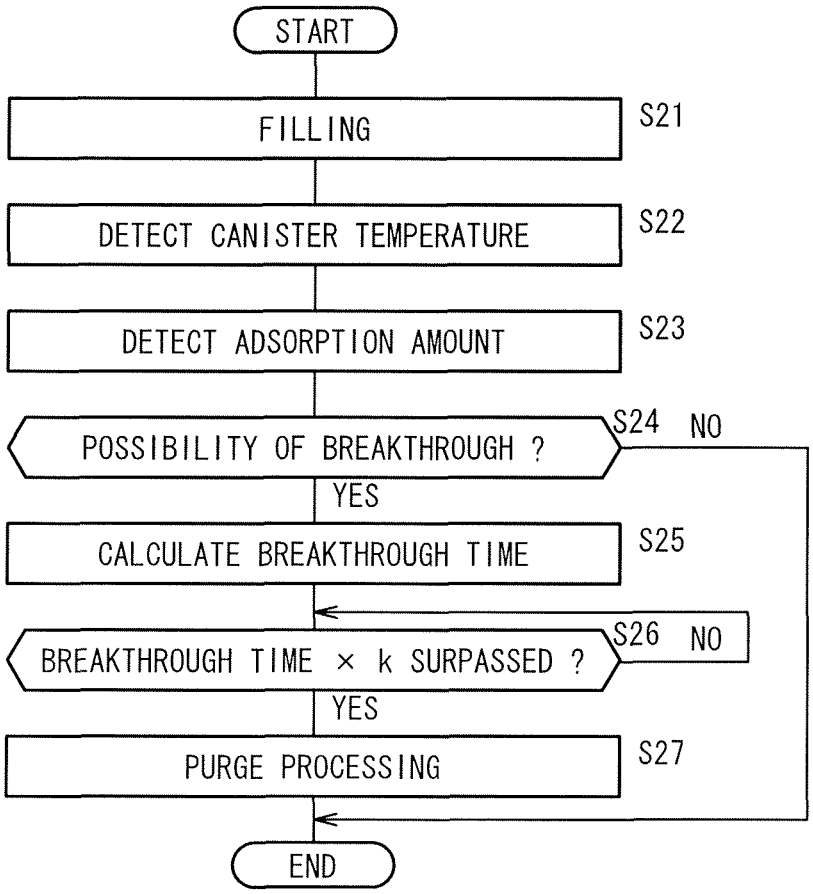
FIG. 9 is a flowchart that describes a purging method in relation to the third embodiment of the present invention.

Operations of the fuel tank equipment 61 shall be described along with the flowchart shown in FIG. 9, in relation to a purging method in accordance with the third embodiment of the present invention. Concerning steps thereof, which are the same as the purging method according to the first embodiment shown in FIG. 4, detailed descriptions of such steps shall be omitted.

At first, when filling of fuel into the fuel tank 12 (step S21) is carried out, because a certain amount of evaporation fuel is introduced into the canister 18, the canister 18 adsorbs the evaporation fuel. In the canister 18, as a result of adsorption, generation of heat is made to occur, and each of the temperature sensors T1 through T6 detects the temperature rise in each of respective areas inside the canister 18.

Figure 8:
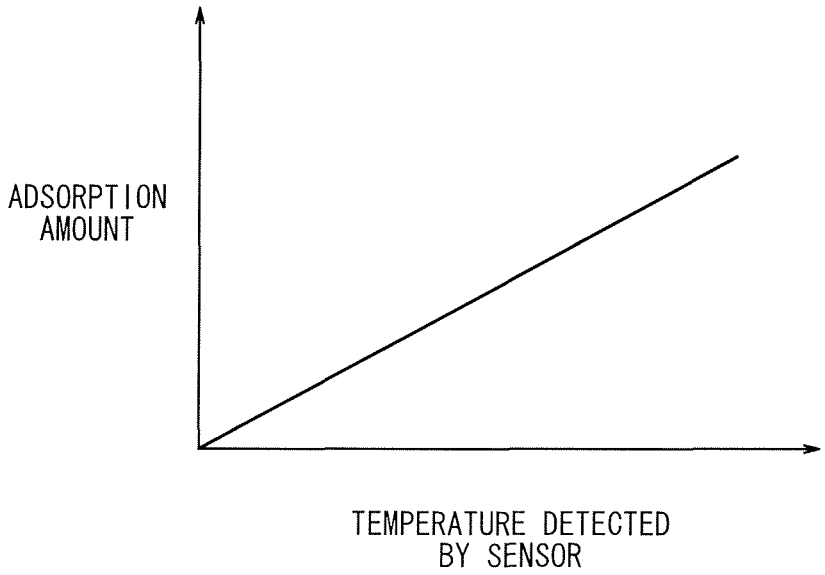
FIG. 8 is a graph showing a relationship between each of detected temperatures of the temperature sensor and the adsorption amount.

The adsorption amount detecting circuit 64, as shown in FIG. 7, detects the adsorption amount of the evaporation fuel adsorbed by the canister 18 from the number of sensors that have reached the adsorption temperature among the temperature sensors T1 to T6 and from the relationship between the sensor-detected temperature and adsorption, as shown in FIG. 8 (step S23). Next, processing is carried out from steps S24 and thereafter.

In this case, according to the third embodiment, before the canister 18, having adsorbed the evaporation fuel due to filling of the fuel tank 12, experiences breakthrough accompanying the passage of time, the engine is started and the evaporation fuel inside the canister 18 can be purged. As a result, the same effects as the aforementioned first embodiment can be obtained.

In addition, in the third embodiment, similar to the aforementioned second embodiment, when the engine is started before the breakthrough time of the canister 18 has elapsed, variations in the adsorption amount of the canister 18, which vary in accordance with the running time of the engine, are taken into consideration, and the breakthrough time of the canister 18 can be recalculated based on such variations.

Figure 10:
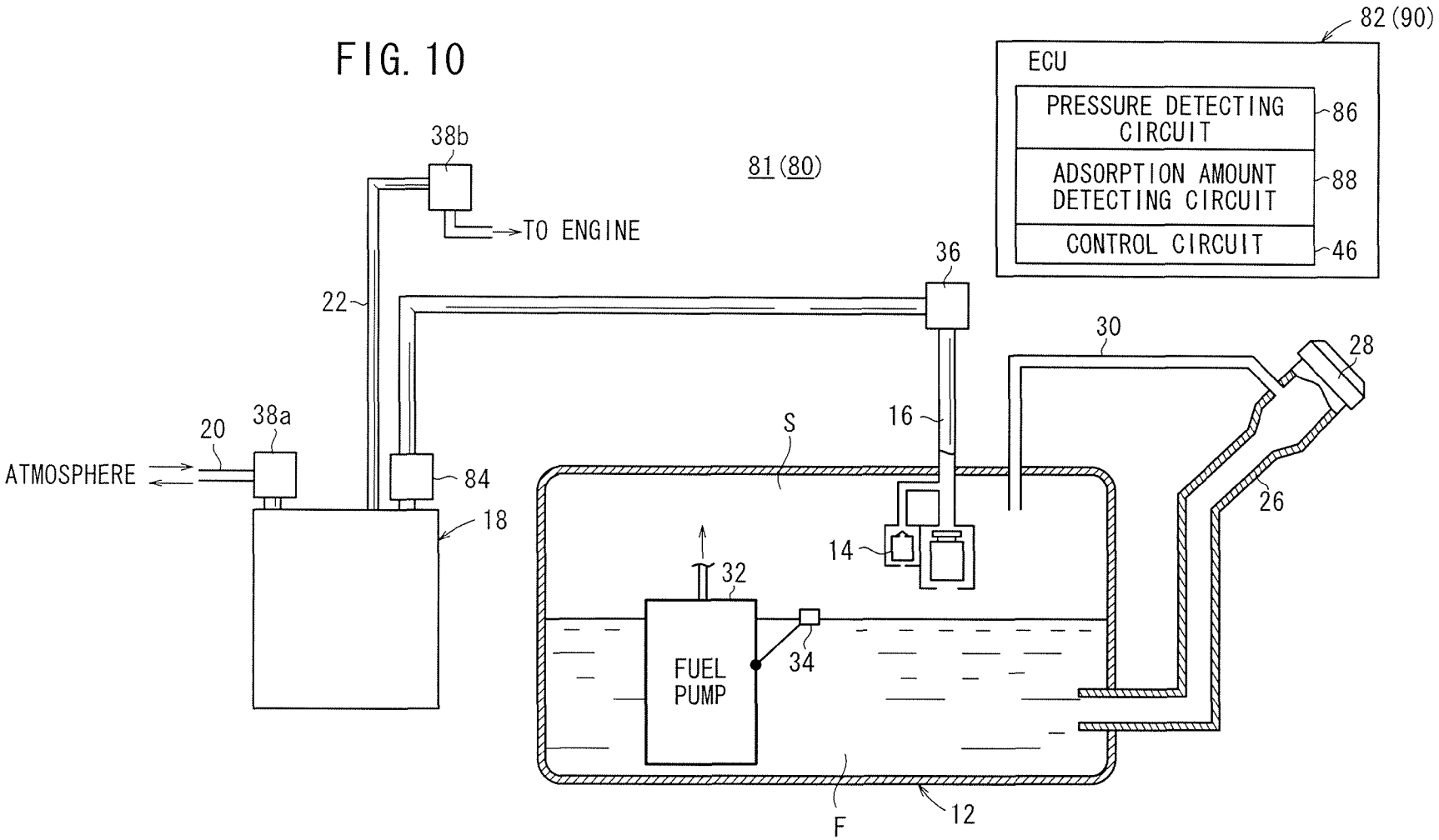
FIG. 10 is an outline schematic view of fuel tank equipment, to which the evaporation fuel processing system according to a fourth embodiment of the present invention is applied.

FIG. 10 is an outline schematic view of fuel tank equipment 81, to which an evaporation fuel processing system 80 according to a fourth embodiment of the present invention is applied.

Driving of the fuel tank equipment 81 is controlled via an ECU (electronic control unit) 82. The ECU 82 comprises a pressure detecting circuit (pressure detecting mechanism) 86 that detects the internal pressure of the canister 18 by means of a signal from a pressure sensor 84 arranged in the vapor passage 16, an adsorption amount detecting circuit (adsorption amount detecting mechanism) 88, which detects an adsorption amount of the evaporation fuel adsorbed by the canister 18 based on a change in the internal pressure of the canister 18 at a time when the canister 18 is sealed, and a control circuit (controller) 46 for starting the engine and carrying out purge processing by opening the purge control valve 38*b* when it is judged that the canister 18 will experience breakthrough based on the amount of evaporation fuel detected by the adsorption amount detecting circuit 88.

Figure 11:
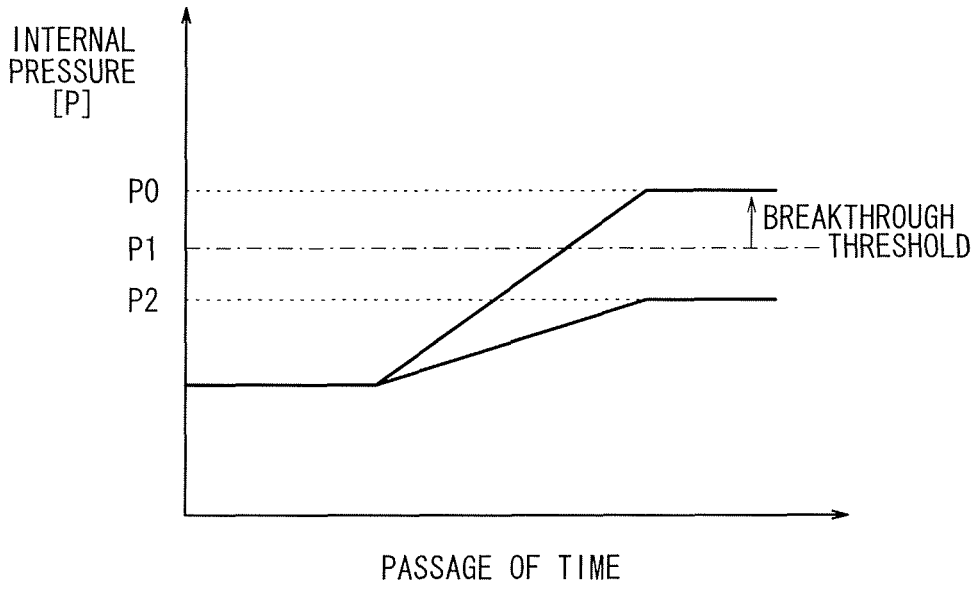
FIG. 11 is a graph showing a relationship between passage of time and canister internal pressure.

FIG. 11 is a graph showing a relationship between passage of time and internal pressure P of the canister 18 when the canister 18 is sealed. The adsorption amount detecting circuit 88 judges that the canister 18 is likely to experience breakthrough, for example, when it is detected that the internal pressure P0 is equal to or greater than an internal pressure P1 of the canister 18 which serves as a threshold pressure P1, or more specifically, when an evaporation fuel adsorption amount is detected that has the possibility of causing breakthrough. A constant relationship exists between the internal pressure of the canister 18 and the evaporation fuel adsorption amount.

The vapor passage 16, the canister 18, the purging passage 22, the drain passage 20, the sealing valves 36, 38*a*, the purge control valve 38*b*, the pressure sensor 84 and the ECU 82 collectively constitute the evaporation fuel processing system 80 according to the fourth embodiment. The evaporation fuel processing system 80 comprises a canister adsorption capacity detecting device 90, and the canister adsorption capacity detecting device 90 comprises the sealing valves (sealing mechanisms) 36, 38*a*, the pressure detecting circuit 86, and the adsorption amount detection circuit 88.

Figure 12:
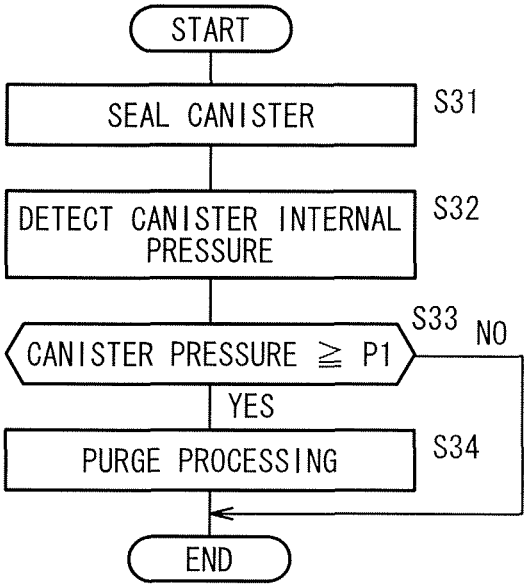
FIG. 12 is a flowchart that describes a control method in relation to the fourth embodiment of the present invention.

Operations of the fuel tank equipment 81 shall be described along with the flowchart shown in FIG. 12, in relation to a control method in accordance with the fourth embodiment of the present invention.

At first, as shown in FIG. 10, the sealing valves 36, 38*a* are closed, together with sealing and closing the purge control valve 38*b*, whereby the canister 18 is sealed (step S31). Under this condition, the pressure detecting circuit 86 detects a change in internal pressure of the canister 18 by means of a detection signal from the pressure sensor 84 (step S32).

As shown in FIG. 11, the adsorption amount detecting circuit 88 detects whether or not the detected internal pressure P of the canister 18 is at or above a threshold value P1, whereby it is judged whether or not the canister 18 contains an evaporation fuel adsorption amount that has the possibility of causing the canister 18 to experience breakthrough. In addition, when it is judged that the detected internal pressure P of the canister 18 is a pressure P0 which is equal to or greater than the threshold value P1 (YES in step S33), the routine proceeds to step S34, whereupon purge processing is carried out.

By means of such purge processing, the control circuit 46 starts the non-illustrated engine together with opening the purge control valve 38*b*. Accordingly, the fuel F that is stored in the fuel tank 12 is supplied to the engine via the fuel pump 32. On the other hand, by supplying air to the engine, a negative pressure is generated in the intake passage (not shown), and the evaporation fuel collected in the canister 18 is suctioned into the purging passage 22 to be purged under a valve-opening action of the purge control valve 38*b*.

At this time, by opening the sealing valve 38*a*, external air flows into the canister 18 from the drain passage 20. Accordingly, the evaporation fuel that was adsorbed by the canister 18 becomes mixed with the introduced external air, and is purged into the intake passage.

Further, in step S33, if it is judged that the detected internal pressure P of the canister 18 is a pressure P2, which is below the threshold P1, i.e., if it is judged that the possibility does not exist for the canister 18 to experience breakthrough (NO in step S33), then the process is brought to an end without carrying out purge processing.

In this case, according to the fourth embodiment, in a state where the canister 18 is sealed, changes in the internal pressure of the canister 18 are detected, and based on such changes in internal pressure, it can be judged whether or not the amount of evaporation fuel adsorbed by the canister 18 is of an evaporation fuel adsorption amount which is likely to cause breakthrough.

Accordingly, without regard to the state of the engine, and specifically whether the engine is being operated or is stopped, the evaporation fuel amount adsorbed by the canister 18 can be detected reliably and with high accuracy at any time, so that versatility of the system can be enhanced.

In addition, before the canister 18 experiences breakthrough, the engine is started and the evaporation fuel inside the canister 18 can be purged. Consequently, especially in a hybrid system, even when the engine is stopped over a prolonged period of time, breakthrough from the canister 18 can reliably be prevented from occurring.

A control method according to the fifth embodiment of the invention shall be described below with reference to FIGS. 13 and 14. In the fifth embodiment, the fuel tank equipment 81 shown in FIG. 10 is used.

Figure 13:
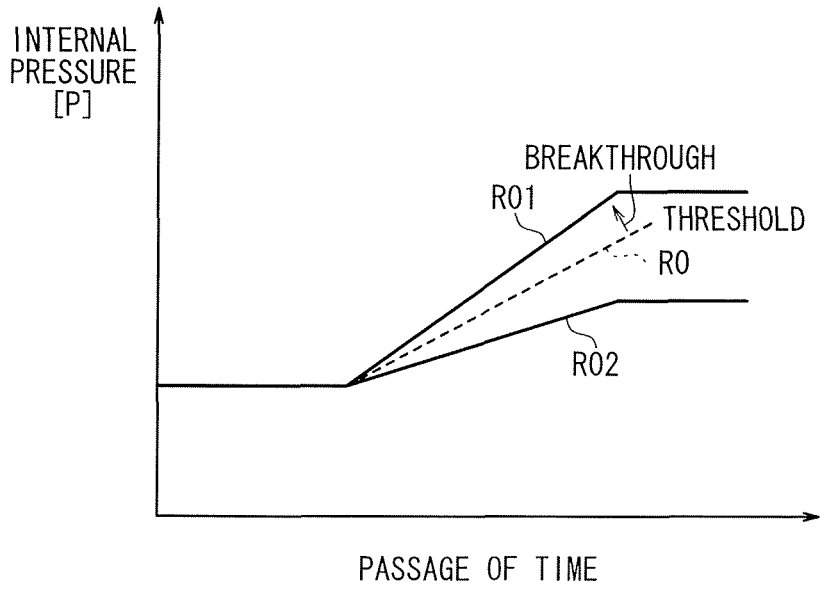
FIG. 13 is a graph showing a relationship between passage of time and a slope of the canister internal pressure, in a control method according to a fifth embodiment of the present invention.

In FIG. 13, there is shown a relationship between the slope of the pressure in the canister 18 and passage of time. The adsorption amount detecting circuit 88 judges whether or not an evaporation fuel adsorption amount exists which has a possibility to cause breakthrough in the canister 18, by detecting whether or not the detected slope of the internal pressure of the canister 18 is greater than a predetermined slope R0. When the adsorption amount of the canister 18 is large, a larger slope R01 is obtained, whereas when the adsorption amount of the canister 18 is small, a smaller slope R02 is obtained.

Figure 14:
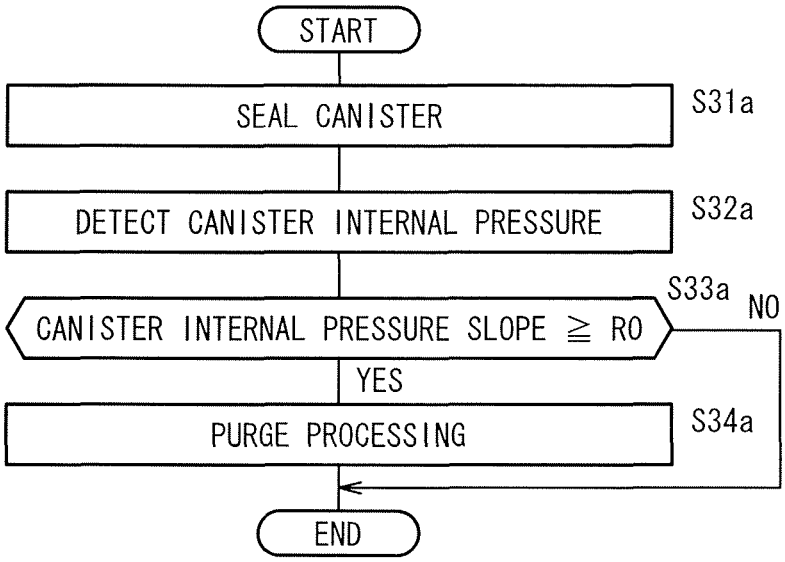
FIG. 14 is a flowchart that describes a control method in relation to the fifth embodiment of the present invention.

According to the fifth embodiment, as shown in FIG. 14, after the canister 18 has been sealed (step S31*a*), the variation in internal pressure of the canister 18 is detected (step S32*a*). As shown in FIG. 13, the adsorption amount detecting circuit 88 detects whether or not the detected slope of the internal pressure of the canister 18 is greater than a predetermined slope R0 that defines a threshold value, whereby it is judged whether or not the canister 18 contains an evaporation fuel adsorption amount that has the possibility of causing the canister 18 to experience breakthrough. In addition, if it is judged that the detected slope of the internal pressure of the canister 18 is of a slope R01, which is greater than the predetermined slope R0 (YES in step S33*a*), then the routine proceeds to step S34*a*, whereupon purge processing is carried out.

In the foregoing manner, according to the fifth embodiment, the slope of the internal pressure of the canister 18 is detected, and based on this slope, it is judged whether or not the amount of evaporation fuel adsorbed by the canister 18 is an evaporation fuel adsorption amount that is capable of causing breakthrough. Owing thereto, in the fifth embodiment, apart from obtaining similar effects to those of the fourth embodiment, it is not necessary to wait until the internal pressure stabilizes, so that it is possible to judge, in a comparatively short period of time, whether there is a possibility for breakthrough to occur.

Figure 15:
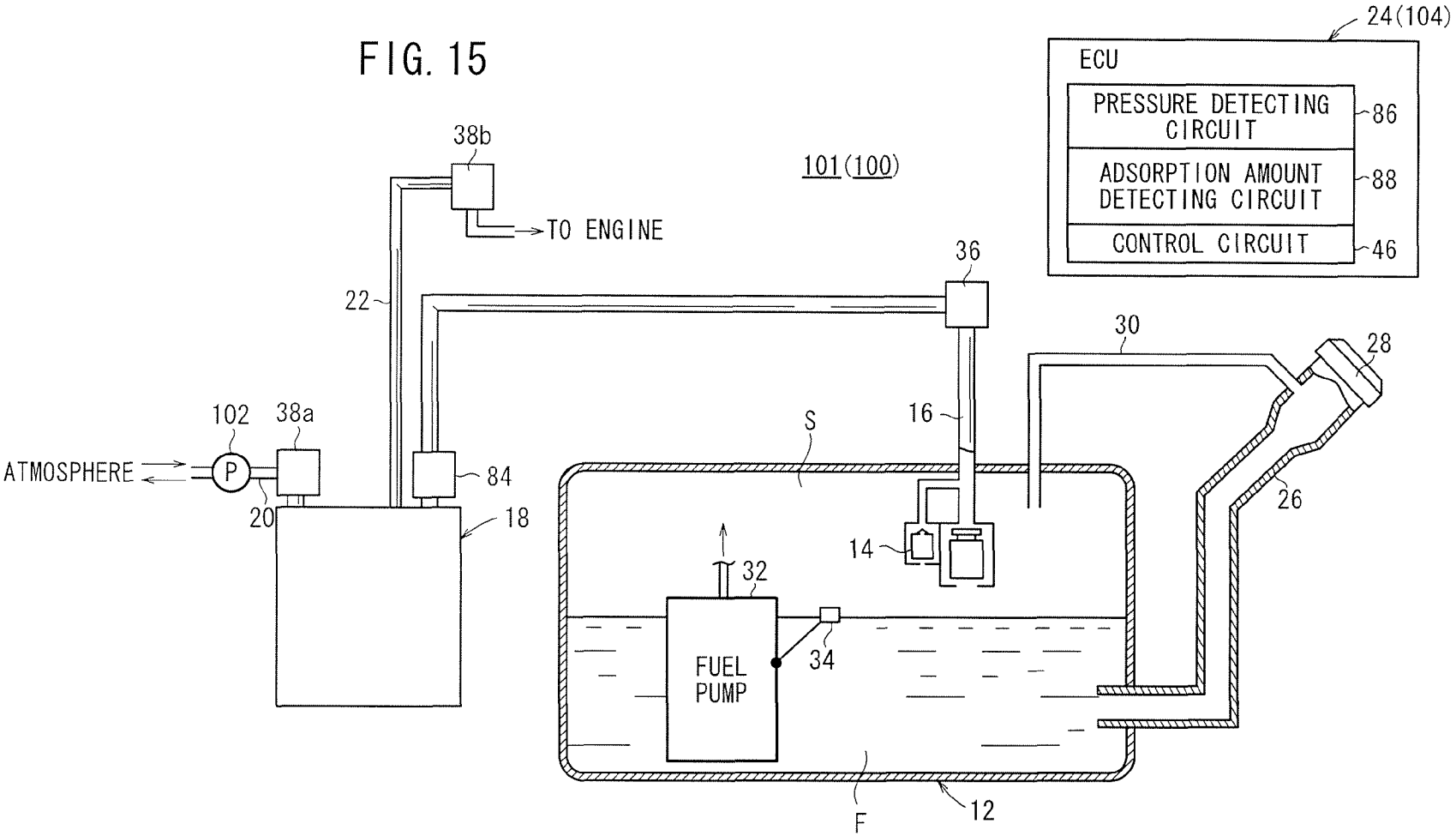
FIG. 15 is an outline schematic view of fuel tank equipment, to which the evaporation fuel processing system according to a sixth embodiment of the present invention is applied.

FIG. 15 is an outline schematic view of fuel tank equipment 101, to which an evaporation fuel processing system 100 according to a sixth embodiment of the present invention is applied.

The fuel tank equipment 101 comprises a pressure reducing mechanism, for example a pump 102, which is arranged in the drain passage 20 and which reduces the pressure of the canister 18. When the pressure of the canister 18 is lowered under an action of the pump 102, based on an internal pressure slope R of the canister 18, the adsorption amount detecting circuit 88 detects the evaporation fuel amount that has been adsorbed by the canister 18.

Figure 16:
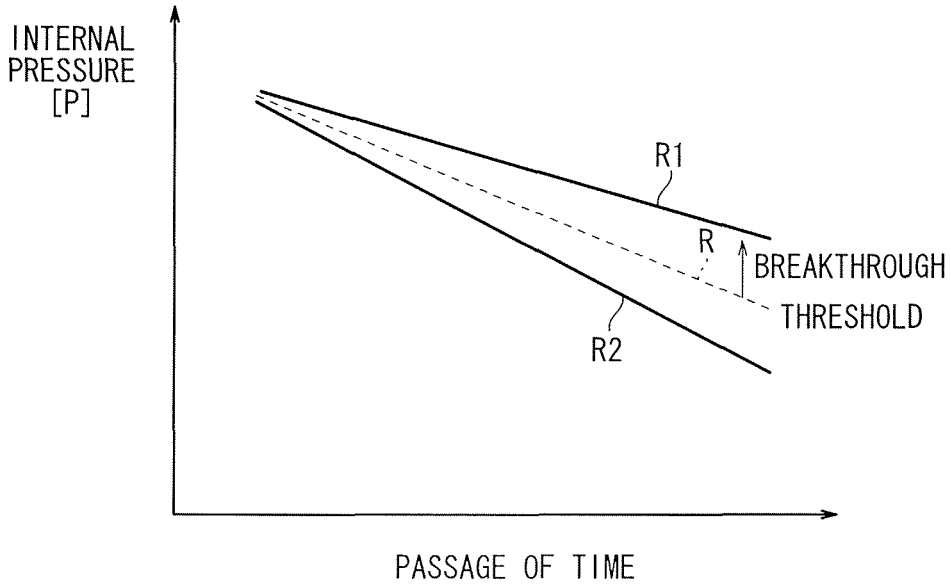
FIG. 16 is a graph showing a relationship between passage of time and canister internal pressure.

FIG. 16 shows the relationship between passage of time and the pressure slope (pressure change) of the internal pressure P of the canister 18 while the pressure in the canister 18 is being reduced. When the adsorption amount detecting circuit 88, for example, detects a slope R1 of small inclination, which is smaller than an internal pressure slope R, which serves as a threshold value for the canister 18, it is judged that the canister 18 is likely to experience breakthrough.

The vapor passage 16, the canister 18, the purging passage 22, the drain passage 20, the sealing valves 36, 38*a*, the purge control valve 38*b*, the pressure sensor 84, the pump 102 and the ECU 24 collectively constitute the evaporation fuel processing system 100 according to the sixth embodiment. The evaporation fuel processing system 100 comprises a canister adsorption capacity detecting device 104, and the canister adsorption capacity detecting device 104 comprises the pump 102, the pressure detecting circuit 86, and the adsorption amount detecting circuit 88.

Figure 17:
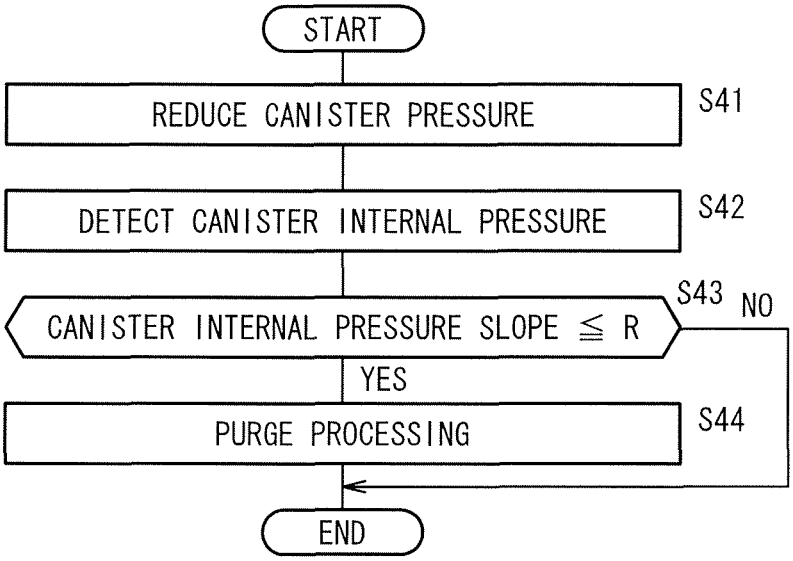
FIG. 17 is a flowchart that describes a control method in relation to the sixth embodiment of the present invention.

Operations of the fuel tank equipment 101 shall be described along with the flowchart shown in FIG. 17, in relation to a control method in accordance with the sixth embodiment of the present invention. Concerning steps thereof, which are the same as the control method according to the fourth embodiment shown in FIG. 12, detailed descriptions of such steps shall be omitted.

According to the sixth embodiment, after the sealing valve 36 and the purge control valve 38*b* have been closed, the pump 102 is driven and the pressure inside the canister 18 is reduced (step S41). At this time, the pressure detecting circuit 86 detects a change in the internal pressure of the canister 18 by means of a signal from the pressure sensor 84 (step S42).

As shown in FIG. 16, the adsorption amount detecting circuit 88 detects whether or not the detected internal pressure slope of the canister 18 is smaller than the internal pressure slope R, whereby it is judged whether or not the canister 18 contains an evaporation fuel adsorption amount that has the possibility of causing the canister 18 to experience breakthrough. When the adsorption amount of the canister 18 is large, an internal pressure slope R1 having a smaller (negative or descending) inclination is obtained, whereas when the adsorption amount of the canister 18 is small, an internal pressure slope R2 having a larger (negative or descending) inclination is obtained. When the adsorption amount is large, the evaporation fuel that is released during the time that the pressure in the canister 18 is being reduced becomes large, and due to the fact, the reduction of pressure inside the canister 18 is suppressed.

In addition, when it is judged that the detected internal pressure slope of the canister 18 is smaller than the internal pressure slope R (YES in step S43), the routine proceeds to step S44, whereupon purge processing is carried out.

In the foregoing manner, according to the sixth embodiment, under a condition in which the pressure of the canister 18 is reduced, a change in the internal pressure slope of the canister 18 is detected, and based on the change in the internal pressure slope, it is judged whether or not the amount of evaporation fuel adsorbed by the canister 18 is an evaporation fuel adsorption amount that is likely to cause breakthrough. Owing thereto, in the sixth embodiment, the same effects as those of the fourth and fifth embodiments are obtained.

A control method according to the seventh embodiment shall be described below with reference to FIGS. 18 and 19. In the seventh embodiment, the fuel tank equipment 101 shown in FIG. 15 is used.

Figure 18:
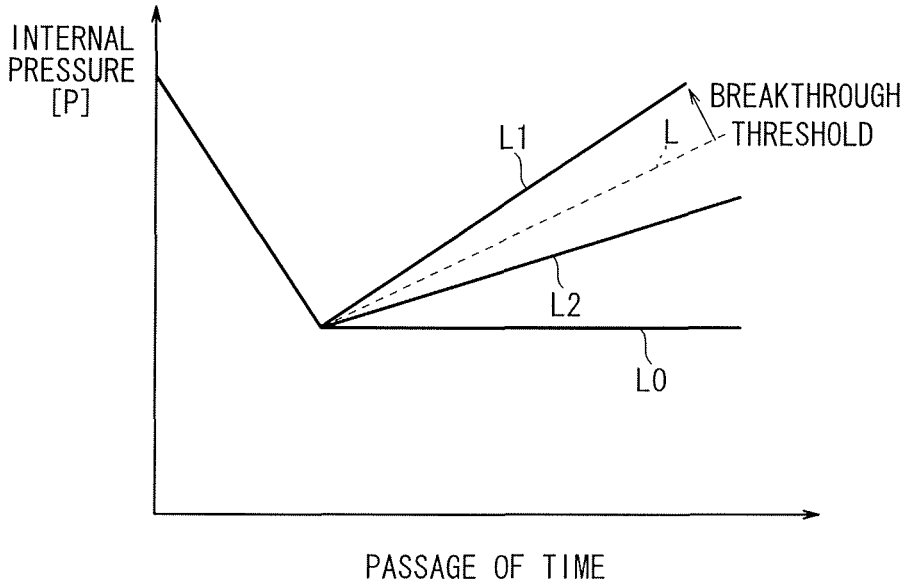
FIG. 18 is a graph showing a relationship between passage of time and canister internal pressure, in a control method according to a seventh embodiment of the present invention.
Figure 19:
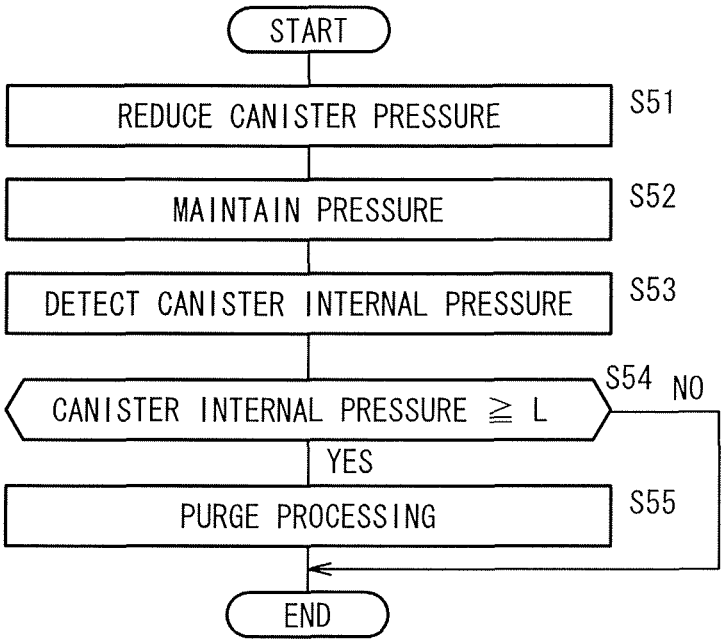
FIG. 19 is a flowchart that describes a control method in relation to the seventh embodiment of the present invention.

FIG. 18 is a graph showing a relationship between passage of time and a pressure slope of the canister 18, under a condition in which the pressure is maintained after the pressure in the canister 18 has been reduced. When the adsorption amount detecting circuit 88, for example, detects a slope L1 of large inclination, which is larger than an internal pressure slope L of the canister 18 that serves as a threshold value, it is judged that the canister 18 is likely to experience breakthrough. Further, in FIG. 18, the internal pressure slope L0 indicates an internal pressure pattern in which evaporation fuel is not present in the canister 18 after the pressure of the canister 18 has been reduced. The internal pressure slope L0 represents a condition in which the reduced pressure is maintained, or stated otherwise, where a condition is maintained in which the internal pressure does not change.

According to the seventh embodiment, after the pressure inside the canister 18 has been reduced (step S51 in FIG. 19), the pressure inside the canister 18 is maintained (step S52). While the pressure is maintained, the pressure detecting circuit 86 detects changes in the internal pressure of the canister 18 by means of a signal from the pressure sensor 84 (step S53).

As shown in FIG. 18, as a result of the adsorption amount detecting circuit 88 detecting whether or not the detected internal pressure slope of the canister 18, after pressure reduction, becomes larger than an internal pressure slope L, it is judged whether or not the canister 18 contains an evaporation fuel adsorption amount that has the possibility of causing breakthrough in the canister 18. When the adsorption amount of the canister 18 is large, a pressure slope L1 of large inclination is obtained, whereas when the adsorption amount of the canister 18 is small, a pressure slope L2 of small inclination is obtained.

In addition, when it is judged that the detected internal pressure slope of the canister 18 is larger than the internal pressure slope L (YES in step S54), the routine proceeds to step S55, whereupon purge processing is carried out.

In the foregoing manner, according to the seventh embodiment, after the pressure of the canister 18 has been reduced, and while the pressure is being maintained, a change in the internal pressure slope of the canister 18 is detected, and based on the change in the internal pressure slope, it is judged whether or not the amount of evaporation fuel adsorbed by the canister 18 is an evaporation fuel adsorption amount that is likely to cause breakthrough. Owing thereto, in the seventh embodiment, the same effects as those of the fourth through sixth embodiments are obtained.

Figure 20:
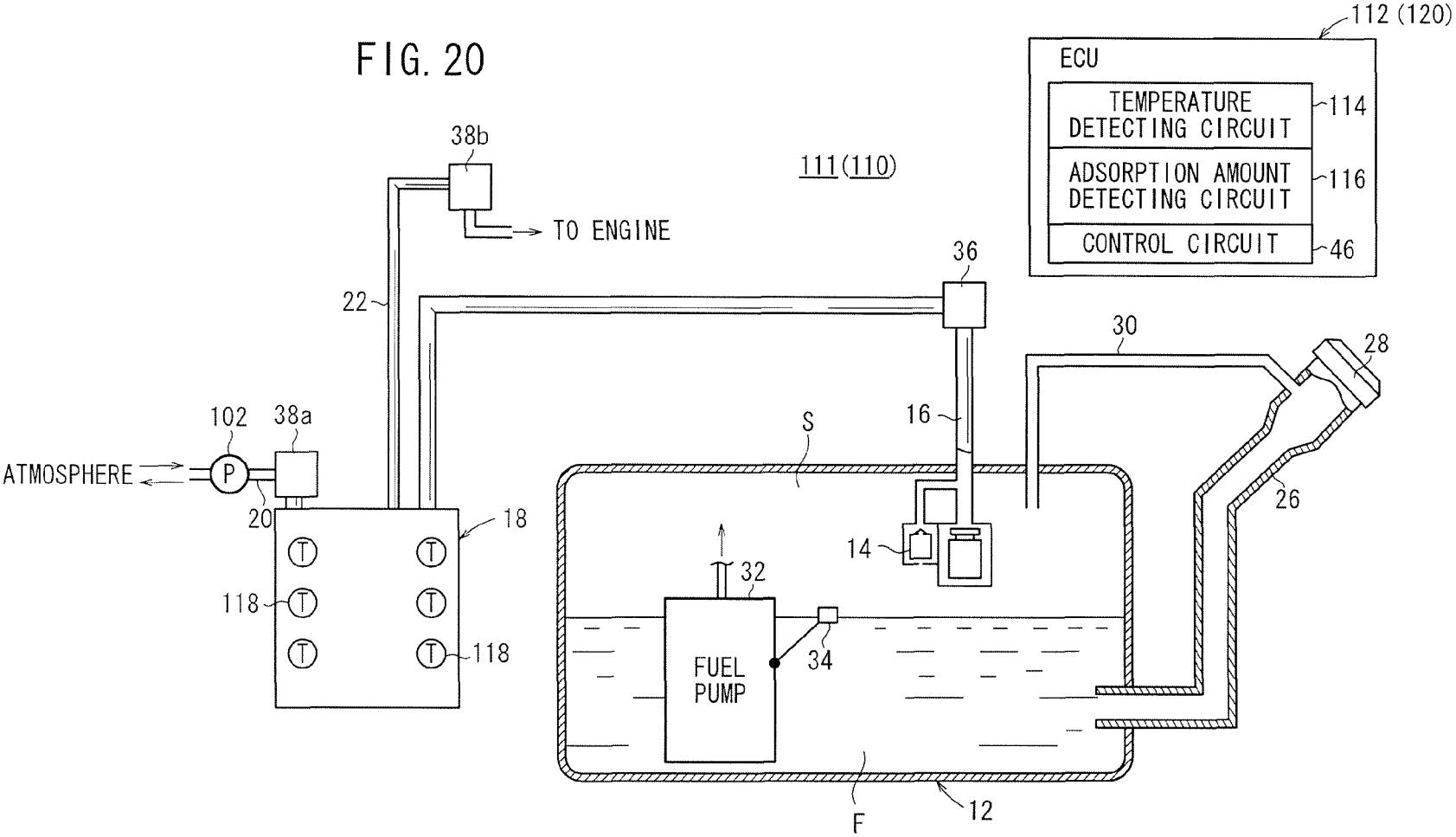
FIG. 20 is an outline schematic view of fuel tank equipment, to which the evaporation fuel processing system according to an eighth embodiment of the present invention is applied.

FIG. 20 is an outline schematic view of fuel tank equipment 111, to which an evaporation fuel processing system 110 according to an eighth embodiment of the present invention is applied.

Driving of the fuel tank equipment 111 is controlled via an ECU (electronic control unit) 112. The ECU 112 comprises a temperature detecting circuit (temperature detecting mechanism) 114 that detects the temperature of the canister 18, and an adsorption amount detecting circuit (adsorption amount detecting mechanism) 116, which detects an adsorption amount of the evaporation fuel adsorbed by the canister 18 based on a change in a temperature gradient (slope) of the canister 18 at a time of reduced pressure therein.

A plurality of temperature sensors 118 is disposed in the canister 18. Each of such temperature sensors 118 detects a temperature change at each of respective areas within the canister 18, and the detected temperature information is transmitted to the temperature detecting circuit 114.

Figure 21:
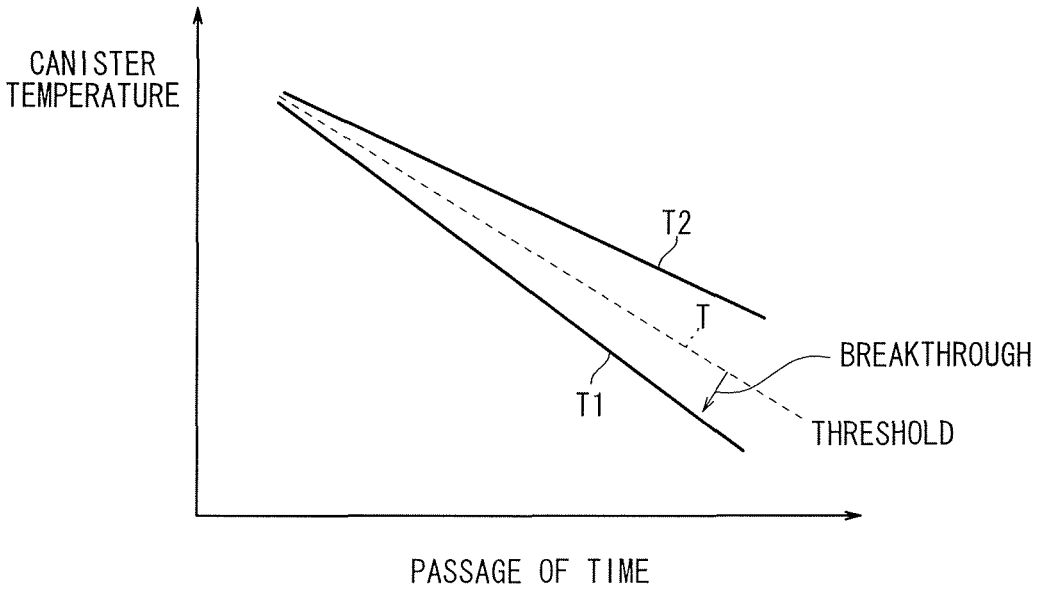
FIG. 21 is a graph showing a relationship between passage of time and canister temperature.

FIG. 21 is a graph showing a relationship between passage of time and a temperature gradient (temperature change) of the canister 18 at a time of reduced pressure. When the adsorption amount detecting circuit 116, for example, detects a temperature gradient (slope) T1 of large inclination, which is larger than a temperature gradient T of the canister 18, which serves as a threshold value, it is judged that the canister 18 is likely to experience breakthrough.

The vapor passage 16, the canister 18, the purging passage 22, the drain passage 20, the sealing valves 36, 38*a*, the purge control valve 38*b*, the temperature sensors 118 and the ECU 112 collectively constitute the evaporation fuel processing system 110 according to the eighth embodiment. The evaporation fuel processing system 110 comprises a canister adsorption capacity detecting device 120, and the canister adsorption capacity detecting device 120 comprises the pump 102, the temperature detecting circuit 114, and the adsorption amount detection circuit 116.

Figure 22:
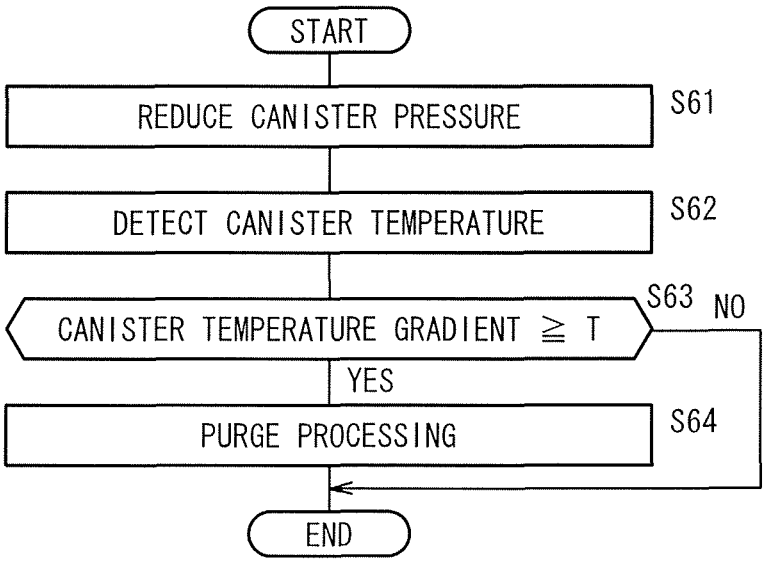
FIG. 22 is a flowchart that describes a control method in relation to the eighth embodiment of the present invention.

Operations of the fuel tank equipment 111 shall be described along with the flowchart shown in FIG. 22, in relation to a control method in accordance with the eighth embodiment of the present invention.

According to the eighth embodiment, the pressure inside the canister 18 is reduced (step S61), and together therewith, the temperature detecting circuit 114 detects a temperature change at each of respective areas inside the canister 18 via the plural temperature sensors 118 (step S62).

As shown in FIG. 21, the adsorption amount detecting circuit 116 detects whether or not the detected temperature gradient of the canister 18 is larger than the temperature gradient T, whereby it is judged whether or not the canister 18 contains an evaporation fuel adsorption amount that has the possibility of causing the canister 18 to experience breakthrough. When the adsorption amount of the canister 18 is large, a temperature gradient (slope) T1 having a larger (negative or descending) inclination is obtained, whereas when the adsorption amount of the canister 18 is small, a temperature gradient T2 having a smaller (negative or descending) inclination is obtained. This occurs because, when the evaporation fuel is released from activated carbon inside the canister 18, a heat-absorbing (endothermic) reaction is caused.

In addition, when it is judged that the detected temperature gradient of the canister 18 is larger than the temperature gradient T (YES in step S63), the routine proceeds to step S64, whereupon purge processing is carried out.

In the foregoing manner, according to the eighth embodiment, under a condition in which the pressure of the canister 18 is reduced, a change in the temperature gradient (slope) of the canister 18 is detected, and based on the change in the temperature gradient, it is judged whether or not the amount of evaporation fuel adsorbed by the canister 18 is an evaporation fuel adsorption amount that is likely to cause breakthrough. Owing thereto, in the eighth embodiment, the same effects as those of the fourth through seventh embodiments are obtained.

Figure 23:
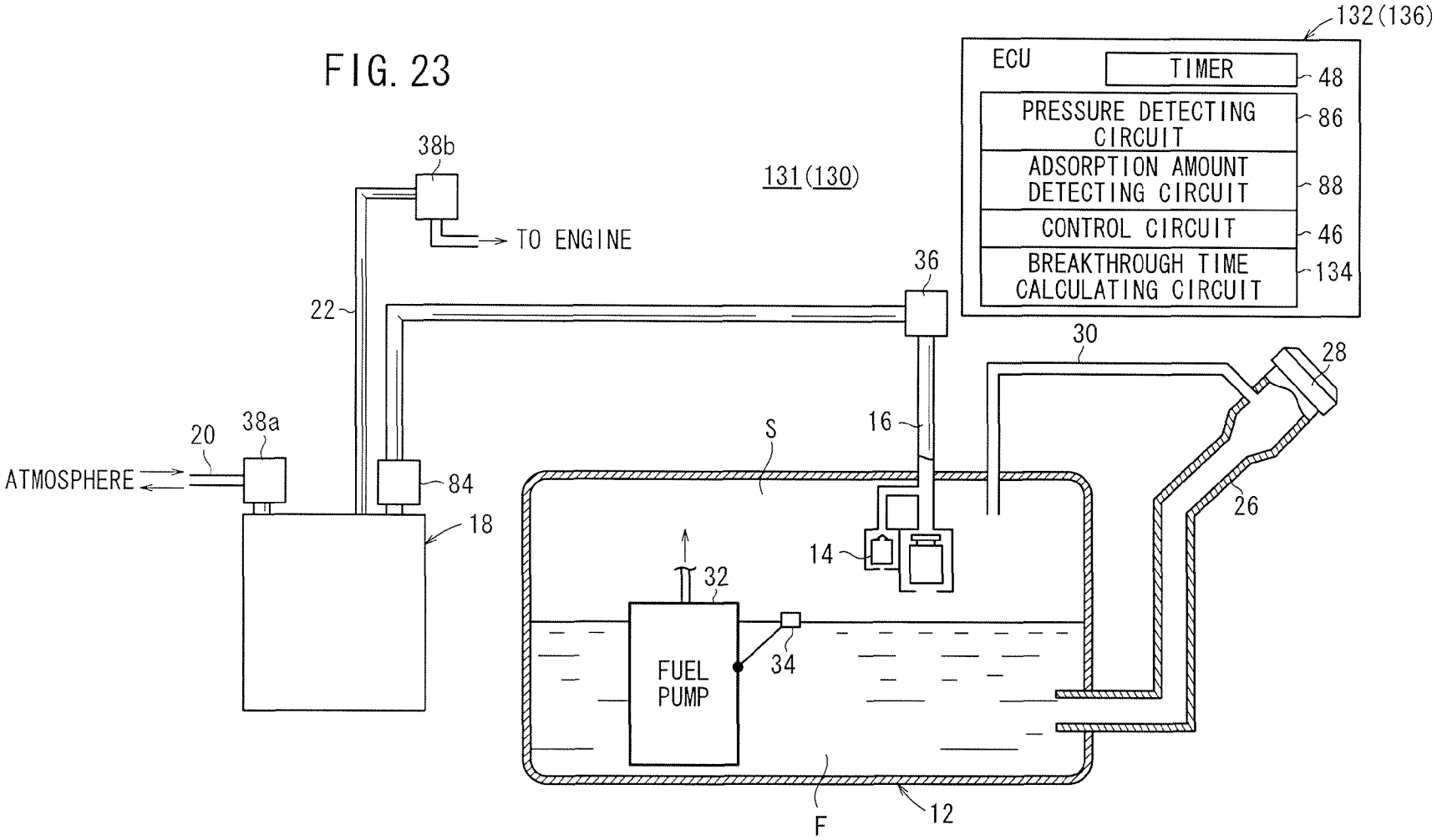
FIG. 23 is an outline schematic view of fuel tank equipment, to which the evaporation fuel processing system according to a ninth embodiment of the present invention is applied.

FIG. 23 is an outline schematic view of fuel tank equipment 131, to which an evaporation fuel processing system 130 according to a ninth embodiment of the present invention is applied. The ninth embodiment utilizes substantially the same features as the fourth embodiment, but is not limited thereby. The features of any of the fifth through eighth embodiments may also be adopted therein.

Driving of the fuel tank equipment 131 is controlled via an ECU (electronic control unit) 132. The ECU 132 comprises a breakthrough time calculating circuit (breakthrough time calculating mechanism) 134, which calculates a time, based on the evaporation fuel amount detected by the adsorption amount detecting circuit 88, up until a time at which the canister 18 would experience breakthrough in the event that the evaporation fuel were not purged from the canister 18. In the ECU 132, a timer 48 is provided, which serves as a timing means.

Figure 24:
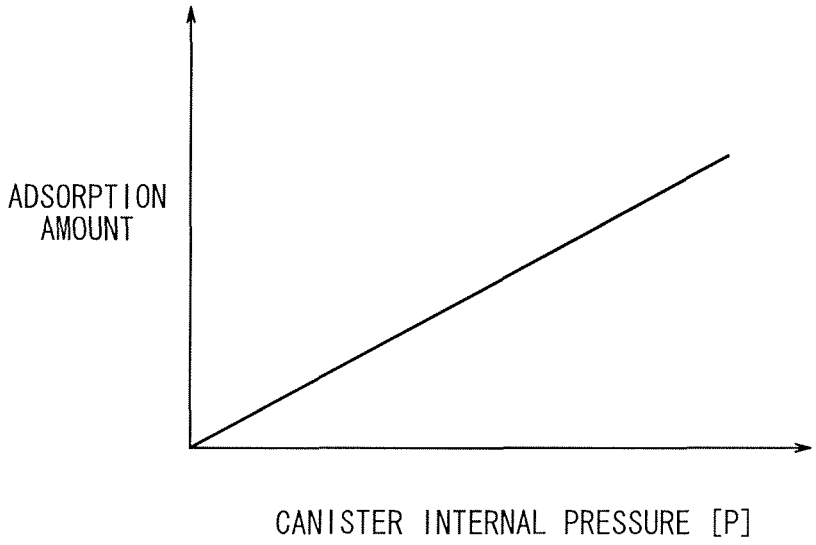
FIG. 24 is a graph showing a relationship between canister internal pressure and an adsorption amount of the fuel.
Figure 25:
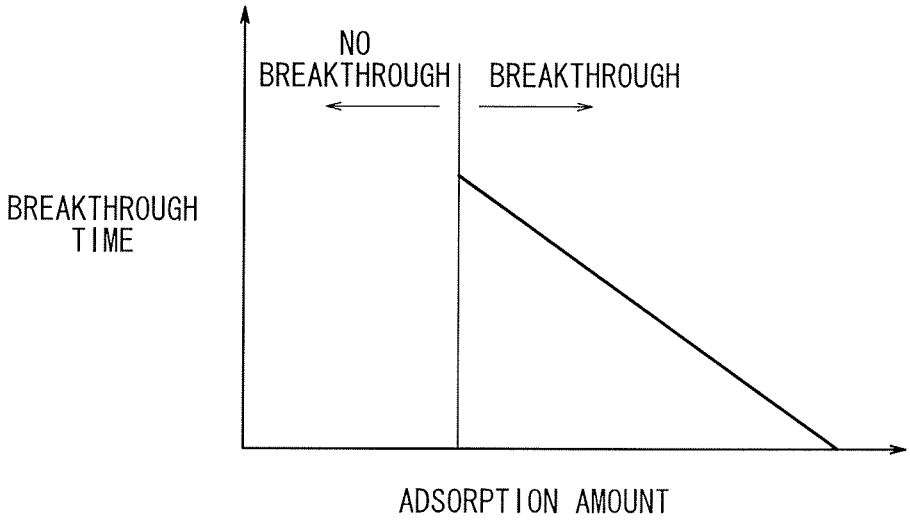
FIG. 25 is a graph showing a relationship between an adsorption amount and a time at which breakthrough occurs.

The adsorption amount detecting circuit 88, for example as shown in FIG. 24, has preset therein beforehand, as a map or as a computational expression, a relationship between the internal pressure inside the canister 18 and the adsorption amount at a time when the canister 18 is sealed. The adsorption amount detecting circuit 88, for example as shown in FIG. 25, also has preset therein beforehand, as a map or as a computational expression, a relationship between the adsorption amount and the time at which breakthrough of the canister 18 will occur.

The vapor passage 16, the canister 18, the purging passage 22, the drain passage 20, the sealing valves 36, 38*a*, the purge control valve 38*b*, the pressure sensor 84 and the ECU 132 collectively constitute the evaporation fuel processing system 130 according to the ninth embodiment. The evaporation fuel processing system 130 comprises a canister adsorption capacity detecting device 136, and the canister adsorption capacity detecting device 136 comprises the breakthrough time calculating circuit 134.

Figure 26:
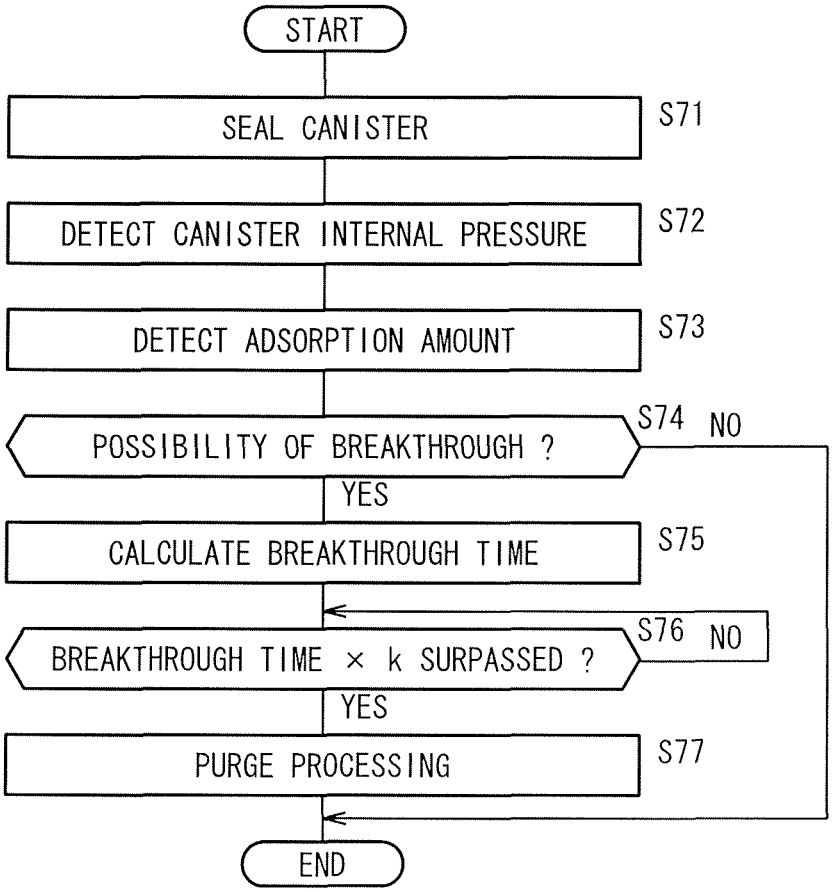
FIG. 26 is a flowchart that describes a control method in relation to the ninth embodiment of the present invention.

Operations of the fuel tank equipment 131 shall be described along with the flowchart shown in FIG. 26, in relation to a control method in accordance with the ninth embodiment of the present invention.

First, the canister 18 is sealed (step S71), and the internal pressure of the canister 18 is detected (step S72). Then, the adsorption amount detecting circuit 88, as shown in FIG. 24, detects the adsorption amount of the evaporation fuel, which is adsorbed by the canister 18, from the detected internal pressure of the canister 18 (step S73).

Next, based on the detected adsorption amount, when it is judged that there is a possibility for breakthrough in the canister 18 to occur (YES in step S74), the routine proceeds to step S75, whereupon the breakthrough time of the canister 18 is calculated (see FIG. 25), which is a time up to when the canister 18 will experience breakthrough. In the control circuit 46, when the calculated breakthrough time×k ($k \leq 1$) is timed via the timer 48, i.e., when it is determined that the breakthrough time×k has elapsed (YES in step S76), the routine proceeds to step S77, whereupon purge processing is carried out.

In this case, according to the ninth embodiment, before the canister 18, which has adsorbed the evaporation fuel, can experience breakthrough along with the passage of time, the engine is started and the evaporation fuel inside the canister 18 can be purged. As a result, especially in a hybrid system, even when the engine is stopped over a prolonged period of time, breakthrough from the canister 18 can reliably be prevented from occurring.

In addition, the adsorption state of the canister 18 can be detected with high precision. Owing thereto, the time during which the internal combustion engine is operated can be suppressed to only a minimum necessary level, so that fuel consumption is decreased, thus making the system and method highly economical.

While the invention has been particularly shown and described with reference to preferred embodiments, it will be understood that variations and modifications can be effected thereto by those skilled in the art without departing from the scope of the invention as defined by the appended claims.

What is claimed is:

1. An evaporation fuel processing system comprising:

a first communication passage through which an evaporation fuel generated inside of a fuel tank that stores fuel is introduced;

a canister connected to the first communication passage and which adsorbs the evaporation fuel;

a second communication passage that communicates between the canister and an intake passage of an internal combustion engine;

a purging processor for purging the evaporation fuel adsorbed by the canister into the internal combustion engine through the second communication passage;

an adsorption amount detecting mechanism which detects an amount of the evaporation fuel adsorbed by the canister by means of filling of the fuel, at a time when the fuel is filled into the fuel tank;

a breakthrough time calculating mechanism for calculating, while the internal combustion engine is stopped, a time based on the detected adsorption amount, at which the canister would experience breakthrough in the event that the evaporation fuel were not purged into the internal combustion engine from the canister;

a controller for carrying out purge processing by the purging processor based on the calculated time.

2. An evaporation fuel processing system according to claim 1, wherein the adsorption amount detecting mechanism further comprises a filling amount detector for detecting the fill amount of the fuel which is filled in the fuel tank, and wherein the adsorption amount is detected based on the detected fill amount.

3. An evaporation fuel processing system according to claim 1, wherein the adsorption amount detecting mechanism further comprises a temperature change detector for detecting a temperature change of the canister at a time when the fuel tank is being filled, and wherein the adsorption amount is detected based on the detected temperature change.

4. An evaporation fuel processing system according to claim 1, wherein the canister adsorption capacity detecting device comprises:

a sealing mechanism for sealing the canister;

a pressure detecting mechanism for detecting an internal pressure of the canister; and an adsorption amount detecting mechanism which detects the adsorption amount of the evaporation fuel adsorbed by the canister based on a change of the internal pressure of the canister, when sealed, wherein the controller carries out purge processing of the evaporation fuel by the purging processor based on a detection result of the adsorption amount detecting mechanism.

5. An evaporation fuel processing system according to claim 4, wherein:

the adsorption amount detecting mechanism detects that the evaporation fuel adsorbed by the canister is at an amount having a capability of causing the canister to experience breakthrough, when the internal pressure of the canister, when sealed, is equal to or greater than a predetermined value; and the controller carries out purge processing of the evaporation fuel by the purging processor when it is detected by the adsorption amount detecting mechanism that the amount of the evaporation fuel adsorbed by the canister has the capability of causing the canister to experience breakthrough.

6. An evaporation fuel processing system according to claim 4, wherein:

the adsorption amount detecting mechanism detects that the evaporation fuel adsorbed by the canister is at an amount having a capability of causing the canister to experience breakthrough, when a slope of the internal pressure change of the canister, when sealed, is equal to or greater than a predetermined slope; and the controller carries out purge processing of the evaporation fuel by the purging processor when it is detected by the adsorption amount detecting mechanism that the amount of the evaporation fuel adsorbed by the canister has the capability of causing the canister to experience breakthrough.

7. An evaporation fuel processing system according to claim 1, wherein the canister adsorption capacity detecting device comprises:

a pressure reducing mechanism for reducing the pressure of the canister;

a pressure detecting mechanism for detecting an internal pressure of the canister; and an adsorption amount detecting mechanism which detects the adsorption amount of the evaporation fuel adsorbed by the canister based on a slope of the internal pressure of the canister during reduction in pressure, wherein the controller carries out purge processing of the evaporation fuel by the purging processor based on a detection result of the adsorption amount detecting mechanism.

8. An evaporation fuel processing system according to claim 7, wherein:

the adsorption amount detecting mechanism detects that the evaporation fuel adsorbed by the canister is at an amount having a capability of causing the canister to experience breakthrough, when the slope of the internal pressure of the canister, during reduction in pressure, is less than a predetermined slope; and the controller carries out purge processing of the evaporation fuel by the purging processor when it is detected by the adsorption amount detecting mechanism that the amount of the evaporation fuel adsorbed by the canister has the capability of causing the canister to experience breakthrough.

9. An evaporation fuel processing system according to claim 1, wherein the canister adsorption capacity detecting device comprises:

a pressure reducing mechanism for reducing the pressure of the canister;

a pressure detecting mechanism for detecting an internal pressure of the canister; and an adsorption amount detecting mechanism which detects the adsorption amount of the evaporation fuel adsorbed by the canister based on a slope of the internal pressure of the canister after reduction in pressure, wherein the controller carries out purge processing of the evaporation fuel by the purging processor based on a detection result of the adsorption amount detecting mechanism.

10. An evaporation fuel processing system according to claim 9, wherein:

the adsorption amount detecting mechanism detects that the evaporation fuel adsorbed by the canister is at an amount having a capability of causing the canister to experience breakthrough, when the slope of the internal pressure of the canister, after reduction in pressure, is greater than a predetermined slope; and the controller carries out purge processing of the evaporation fuel by the purging processor when it is detected by the adsorption amount detecting mechanism that the amount of the evaporation fuel adsorbed by the canister has the capability of causing the canister to experience breakthrough.

11. An evaporation fuel processing system according to claim 1, wherein the canister adsorption capacity detecting device comprises:

a pressure reducing mechanism for reducing the pressure of the canister;

a temperature detecting mechanism for detecting a temperature of the canister; and an adsorption amount detecting mechanism which detects the adsorption amount of the evaporation fuel adsorbed by the canister based on a temperature slope of the canister during reduction in pressure, wherein the controller carries out purge processing of the evaporation fuel by the purging processor based on a detection result of the adsorption amount detecting mechanism.

12. An evaporation fuel processing system according to claim 11, wherein:

the adsorption amount detecting mechanism detects that the evaporation fuel adsorbed by the canister is at an amount having a capability of causing the canister to experience breakthrough, when the temperature slope of the canister, during reduction in pressure, is greater than a predetermined slope; and the controller carries out purge processing of the evaporation fuel by the purging processor when it is detected by the adsorption amount detecting mechanism that the amount of the evaporation fuel adsorbed by the canister has the capability of causing the canister to experience breakthrough.

13. A purging method for an evaporation fuel processing system, in which the evaporation fuel processing system comprises:

a first communication passage through which an evaporation fuel generated inside of a fuel tank that stores fuel is introduced;

a canister connected to the first communication passage and which adsorbs the evaporation fuel;

a second communication passage that communicates between the canister and an intake passage of an internal combustion engine; and a purging processor for purging the evaporation fuel adsorbed by the canister into the internal combustion engine through the second communication passage, the method comprising the steps of:

detecting the adsorption amount of the evaporation fuel adsorbed by the canister by means of filling of the fuel, at a time when the fuel is filled into the fuel tank;

calculating, while the internal combustion engine is stopped, a time based on the detected adsorption amount, at which the canister would experience breakthrough in the event that the evaporation fuel were not purged into the internal combustion engine from the canister;

carrying out purge processing by the purging processor based on the calculated time.

14. A purging method according to claim 13, further comprising the steps of:

detecting the fill amount of the fuel which is filled in the fuel tank; and detecting the adsorption amount based on the detected fill amount.

15. A purging method according to claim 13, further comprising the steps of:

detecting a temperature change of the canister at a time when the fuel tank is being filled; and detecting the adsorption amount based on the detected temperature change.

16. A purging method according to claim 13, further comprising the steps of:

detecting an internal pressure of the canister under a condition in which the canister is sealed;

detecting the adsorption amount of the evaporation fuel adsorbed by the canister based on a change of the internal pressure of the canister, when sealed; and carrying out purge processing of the evaporation fuel by the purging processor based on the detected amount of the evaporation fuel.

17. A purging method according to claim 16, further comprising the steps of:

detecting that the evaporation fuel is adsorbed by the canister at an amount having a capability of causing the canister to experience breakthrough, when the internal pressure of the canister, when sealed, is equal to or greater than a predetermined value; and carrying out purge processing of the evaporation fuel by the purging processor when it is detected that the amount of the evaporation fuel adsorbed by the canister has the capability of causing the canister to experience breakthrough.

18. A purging method according to claim 16, further comprising the steps of:

detecting that the evaporation fuel adsorbed by the canister is at an amount having a capability of causing the canister to experience breakthrough, when a slope of the internal pressure change of the canister, when sealed, is equal to or greater than a predetermined slope; and carrying out purge processing of the evaporation fuel by the purging processor when it is detected that the amount of the evaporation fuel adsorbed by the canister has the capability of causing the canister to experience breakthrough.

19. A purging method according to claim 13, further comprising the steps of:

reducing a pressure of the canister;

detecting an internal pressure of the canister; and detecting an amount of the evaporation fuel adsorbed by the canister based on a slope of the internal pressure of the canister during reduction in pressure; and carrying out purge processing of the evaporation fuel by the purging processor based on the detected amount of the evaporation fuel.

20. A purging method according to claim 19, further comprising the steps of:

detecting that the evaporation fuel adsorbed by the canister is at an amount having a capability of causing the canister to experience breakthrough, when the slope of the internal pressure of the canister, during reduction in pressure, is less than a predetermined slope; and carrying out purge processing of the evaporation fuel by the purging processor when it is detected that the amount of the evaporation fuel adsorbed by the canister has the capability of causing the canister to experience breakthrough.

21. A purging method according to claim 13, further comprising the steps of:

reducing a pressure of the canister;

detecting an internal pressure of the canister;

detecting an amount of the evaporation fuel adsorbed by the canister based on a slope of the internal pressure of the canister after reduction in pressure; and carrying out purge processing of the evaporation fuel by the purging processor based on the detected amount of the evaporation fuel.

22. A purging method according to claim 21, further comprising the steps of:

detecting that the evaporation fuel adsorbed by the canister is at an amount having a capability of causing the canister to experience breakthrough, when the slope of the internal pressure of the canister, after reduction in pressure, is greater than a predetermined slope; and carrying out purge processing of the evaporation fuel by the purging processor when it is detected that the amount of the evaporation fuel adsorbed by the canister has the capability of causing the canister to experience breakthrough.

23. A purging method according to claim 13, further comprising the steps of:

reducing a pressure of the canister;

detecting a temperature of the canister;

detecting the amount of the evaporation fuel adsorbed by the canister based on a temperature slope of the canister during reduction in pressure; and carrying out purge processing of the evaporation fuel by the purging processor based on the detected amount of the evaporation fuel.

24. A purging method according to claim 23, further comprising the steps of:

detecting that the evaporation fuel adsorbed by the canister is at an amount having a capability of causing the canister to experience breakthrough, when the temperature slope of the canister, during reduction in pressure, is greater than a predetermined slope; and carrying out purge processing of the evaporation fuel by the purging processor when the amount of the evaporation fuel adsorbed by the canister has the capability of causing the canister to experience breakthrough.

* * * * *